US006682083B2

(12) United States Patent
Melcher

(10) Patent No.: US 6,682,083 B2
(45) Date of Patent: Jan. 27, 2004

(54) SNOWBOARD SYSTEM

(76) Inventor: Daniel J. Melcher, 13656 S. 36th Way, Phoenix, AZ (US) 85044

( * ) Notice: Subject to any disclaimer, the term of this patent is extended or adjusted under 35 U.S.C. 154(b) by 46 days.

(21) Appl. No.: 10/085,578

(22) Filed: Feb. 26, 2002

(65) Prior Publication Data

US 2002/0185828 A1 Dec. 12, 2002

Related U.S. Application Data

(60) Provisional application No. 60/271,476, filed on Feb. 26, 2001.

(51) Int. Cl.[7] ..... B62B 9/04; B62B 13/00; A63C 11/00; B63B 1/00

(52) U.S. Cl. ..... 280/14.26; 280/15; 280/18; 280/817; 441/73

(58) Field of Search ..... 280/14.21, 14.26, 280/15, 16, 17, 18, 22, 22.1, 28.14, 28.15, 601, 602, 608, 609, 617, 618, 815, 816, 817, 818, 845; 441/68, 72, 73

(56) References Cited

U.S. PATENT DOCUMENTS 2,584,122 A * 2/1952 Gilmore ..... 114/61.16
2,609,210 A * 9/1952 Jennings ..... 280/14.28
3,123,375 A * 3/1964 Courtney ..... 280/14.28
4,175,759 A * 11/1979 Strunk ..... 280/16
4,334,691 A * 6/1982 Scheib ..... 280/14.21
4,647,062 A * 3/1987 McDougall ..... 280/607
5,458,370 A * 10/1995 Melcher ..... 280/817
5,558,354 A * 9/1996 Lion ..... 280/607
5,643,029 A * 7/1997 Rudofsky ..... 441/76
5,752,709 A * 5/1998 Melcher ..... 280/28.15
6,068,269 A * 5/2000 Bergeron ..... 280/21.1

* cited by examiner

*Primary Examiner*—Brian L. Johnson
*Assistant Examiner*—M B Klebe
(74) *Attorney, Agent, or Firm*—Martin L. Stoneman

(57) ABSTRACT

A snowboard-type ski system and apparatus utilizing two skis and rotary linkage to provide the skier with the natural feel of snowboarding and the response and control of two skis. The system coordinates and maintains parallel alignment, vertical motion, and consistent horizontal separation of the two skis through the use of two linkage cranks which rotate about an axis transverse to the direction of travel intended for the two skis. The linkage includes an elevated mounting assembly positioned between the two skis and above the snow upon which a skier may mount bindings. The points of attachment and rotation are between the skier's feet such that the point of attachment to the two skis is proximate to the ski manufacturer's intended loading point. The transverse rotary motion permits the two skis to cant with respect to one another, as the skier enjoys rough terrain, and maintains' natural motion and transfer of force between the two skis.

34 Claims, 12 Drawing Sheets

SNOWBOARD SYSTEM

CROSS-REFERENCE TO RELATED APPLICATION

The present application is related to Application Serial No. 60/271,476, filed Feb. 26, 2001, entitled "DYNAMIC VARIABLE GEOMETRY SNOWBOARD", which is incorporated herein by this reference, and which is not admitted to be prior art with respect to the present invention by the mention in this cross-reference section.

BACKGROUND

This invention relates to a snowboard-type of ski system. More specifically, the invention provides a winter recreation device combining the response and control of high performance skis with the freedom and "feel" of the ride on a snowboard.

Snow skiing generally refers to sports making use of separate skis attached by foot bindings to a skier's feet for the purpose of negotiating snow and/or ice covered terrain. To provide quick response and agility, a typical alpine ski is relatively narrow; and it therefore has a relatively low surface area for its length. The combined surface area of both skis generally keeps the skier from sinking too deeply into powder, thus slowing; and each ski provides two edges for control on ice. However, with both skis independent the skier must, at times, work to maintain control in keeping the skis from crossing, hooking onto each other or the snow, or diverging from a parallel path. Snowboards have entered the winter recreation arena as an alternative to traditional skis. With a wider surface, the skier is not as prone to sink in powder, nor will the skier be challenged to keep two independent skis in unified alignment. However, the width of the board severely reduces the dexterity and mobility that can be enjoyed with traditional skis; and further, the snowboard has only one edge—a significant issue with overall control and turning.

To describe the process of turning, it is practical to first describe the process with regard to a ski. It is also necessary to review the basic parts of a ski. A ski has a bottom, side edges, a tail, and a tip. Typically, the edges of a ski are metal. Further, the tip of the ski is angled up from the plane in which the majority of the ski substantially rests, and the material forming the ski is brought to a narrow point. This upwardly-curved portion of the tip is traditionally referred to as the shovel of the ski. Alpine skis are typically of a cantilever design in that they are thicker in their midsection and taper towards the tail and the tip. The cantilever design allows the skier's weight to be applied in the thickest part of the ski and then distributed over the entire length of the ski. Such distribution ensures a uniform flex and radius of curvature, as intended by the ski manufacturer.

When weight is equally applied to the ski, the ski will travel in a straight path down the hill. A turn is accomplished by the skier shifting his or her weight to place an increased concentration of weight on the edge of the ski in the direction of the turn, i.e., the skier's weight is shifted towards the inside of the turn and forward on the ski. Such action is commonly referred to as "rolling over on the edge." This shift of weight to the edge of the ski causes the edge of the ski to bite into the snow. The shift of weight forward causes the ski to deform, shortening the radius of curvature along the edge biting the snow, and initiates the turn. The shovel of the ski, now angled as well, is able to "carve" into the snow, as well, and guides the ski through the turn. This style of turning is known as "carving."

If the weight of the rider is applied too far forward of the intended mounting point, as conceived by the ski designer, the distribution of weight will be improper—the shovel will be caused to dig and the tail will lift, reducing the overall controlling contact of the edge of the ski with the surface of the snow. Likewise, if the skier's weight is applied far behind the intended mounting point, the tip and shovel will not track, and the initiation of a carve turn by rolling the edge over will be frustrated. By design, the optimum point of contact for weight distribution for a ski is the intended mounting point indicated by the ski manufacturer. When skiing with two skis and carving a turn, the inside edge of both skis, with respect to the inside of the turn, are in contact with the snow and tracking through the turn. To accomplish this positioning, one ski is extended away from the skier farther than the other.

The process of turning a snowboard is quite similar. By design, a snowboard is much more uniform in thickness throughout its length, and the stance of the snowboarded is fore and aft of the center of the board. As with a ski, a turn is effectuated by rolling the edge of the board, which in turn, causes the radius of curvature for the board to change, the edge to bite, and the board to carve through the turn.

For both the ski and the snowboard, lateral gravitational forces build and pull against the skier as the ski or board carves around the turn. The skier counteracts this G-force by leaning, and thereby, shifting his or her center of gravity to stay precisely in line with the centrifugal and gravitational forces encountered throughout the turn. If the force applied by the skier to the edge of the ski or board is insufficient, the ski or board will slide, and the turn will fail. Likewise, if the force is too great, the edge will breakaway from the snow surface, and the turn will fail as the skier slides sideways, falls, or worse.

Even when simply traversing across the slope, it is the edge and its contact with the snow that permits the skier to avoid sliding downhill. In practice, when skiing on two skis, a skier traversing a slope has one ski slightly higher than the other ski, permitting the skier to remain vertical, and causing the uphill edges of the skis to dig into the snow for directional control. It should be noted that this arrangement of the skis, one above the other, is the same relative configuration of the skis with respect to one another as occurs in the process of carving a turn where one ski is extended further from the skier than the other so that the edge can bite and carve through the turn. Thus, it can be seen that effective edge contact and the length of the edge of the ski or snowboard in contact with the snow during a turn or in a traverse is highly important.

The present invention relates to interconnecting preferably two alpine-type skis for the purpose of enjoying the feel of snowboarding with the advantages provided by alpine skis regarding agility of turning, response, and edge contact.

The known prior art relating to interconnecting or coupling two skis is generally concerned with rocker arm devices, or "a-arm" devices. Such devices have an axis of rotation that is parallel to the axis of the ski and concentrate the skier's weight fore and aft of the preferred loading point intended by the designer of the ski, e.g., as disclosed in U.S. Pat. Nos. 5,558,354 (Lion) and 4,175,759 (Strunk). More specifically, the application of the skier's weight to the skis is determined by the rocker arms positioned directly beneath the boot bindings. To permit a snowboard fore and aft stance, these rocker arms are necessarily mounted to the skis fore and aft of the manufacturer's intended loading spot. Because of the physics involved in such level arm devices, in most cases, the horizontal distance between the edges of the skis will not be maintained, and in fact, will grow narrower as one ski is extended further below the other. Systems such as Lion and Strunk are further limited in that the parallel axis of rotation prohibits cant of one ski relative to the other, e.g., one ski is simply lifted in its entirety. The mechanics of such rocker arm linkage systems also necessitate substantially raising the platform upon which the bindings will be affixed to permit the skier to attach his or her boots. Such a rise in elevation may be undesirable in many situations, as it causes the skier's center of gravity to be elevated further away from the snow.

Such lifting of one ski relative to the other assumes that the snow upon which the device is being used is relatively smooth. "Rough", as applied to terrain, can have a variety of different meanings, depending upon the scale employed to measure roughness. Typically, in alpine skiing and snowboarding, roughness is desired on a large scale, such as a truly inclined snow-covered slope of a mountain. Many skiers enjoy the challenge of skiing through moguls, small mounds of snow. As used herein with regard to skiing, "rough" means having bumps of a diameter less than one ski length and, particularly, of a diameter approximately equal to the distance separating the outer edges of the two skis.

On rough terrain, recreational equipment of the rocker arm prior art form will, at best, provide a bumpy ride, for the simple lifting of a ski does not provide sufficient control over the position of the skis and proper distribution of the skier's weight. It is desirable that the linkage between the skis provide some resiliency to accommodate rough terrain, and more specifically, to permit the skis to cant as necessary to maintain desired contact with the snow surface.

OBJECTS AND FEATURES OF THE INVENTION

A primary object and feature of the present invention is to fulfill the above-mentioned needs by the provision of an improved system for winter recreation akin to snowboarding, particularly a device incorporating feel of snowboarding with the response and control of alpine-style skis. An object and feature of the invention is to provide a system for dynamically linking two skis in such a manner as to achieve coordination of ski edge alignment. Another object and feature of the present invention is to support the linkage and rider assembly coordinating the two skis above the two skis, in such manner that it is not in contact with the snow.

Yet another object and feature of the present invention is to improve rider balance, control, and efficiency by moving the force that a rider exerts on a present day snowboard or snowboard-style device from fore and aft of the board manufacturer's intended center point when carving to specifically coincide with the ski manufacturer's intended center point of two alpine skis operating in a coordinated fashion.

Further, it is an object and feature hereof, by incorporating lateral rotation in the linkage assembly, to provide for cant of the skis over rough terrain. Still another object and feature of the present invention is to maintain substantially parallel alignment among the skis and the main assembly of the linkage. Yet another object and feature of the present invention is to permit vertical motion among the skis and the main assembly of the linkage. Another object and feature of the present invention is to provide such coordination of edge alignment while permitting longitudinal cant of the skis relative to one another. Additionally, an object and feature of the invention is to provide a linkage system for interconnecting two skis and controlling the lift and cant of the skis.

Still another object and feature of the present invention is to maintain a fixed horizontal separation between the skis. More specifically, it is an object and feature of the present invention to maintain a fixed horizontal separation between the skis to maintain proper and consistent distribution of the rider's weight and applied force as translated to the left or right edges of the skis when turning. Still another object and feature of the present invention is a linkage system that permits the rider's feet to be placed fore and aft of the intended mounting position, as intended by the ski designer, but which applies the weight and force of the rider to the intended mounting position, as intended by the ski designer. More specifically, it is an object and feature of the invention to permit the rider to enjoy a snowboard stance, while permitting the skis to carve, as they are designed to do.

Still another object and feature of the present invention is to provide a linkage system that transfers rotational torque, as applied by the skier, to both skis, such that both skis roll the edge to carve a turn. Still another object and feature of the present invention is to provide a linkage system using only rotary motion about an axis transverse to the longitudinal axis of the skis for controlling two interconnected skis. Another object and feature of the invention is to use only rotary motion for lifting one ski relative to a second ski. Still another object and feature of the present invention is the use of only two skis, which is desirable, as skis are typically sold only in matched sets.

Still another object and feature of the present invention is to provide the ability to maintain a relatively low point for mounting the rider's bindings, thereby minimizing vertical displacement of the rider's center of gravity. A further object and feature of the invention is that the controlling linkage between the two skis be resilient to rough terrain. Still another object and feature of the invention is to permit the rider, employing normal fore and aft stance, to have a natural fore and aft feeling of horizontal motion as he or she leans forwards or backwards to initiate a turn.

Additional objects and features of the invention will be set forth in the following description, and in part, will be obvious from the following description, and/or may be learned and realized through practice of the invention.

SUMMARY OF THE INVENTION

According to a preferred embodiment of the present invention, this invention provides a snowboard system, comprising, in combination: at least one first ski lying substantially in a first plane and having a first longitudinal axis; at least one second ski lying substantially in a second plane and having a second longitudinal axis; at least one mounting assembly structured and arranged to mount at least one boot binding; and at least one linkage structured and arranged to link the at least one mounting assembly to and between the at least one first ski and the at least one second ski; the at least one mounting assembly lying normally in a substantially horizontal third plane above the first and second planes and having a third longitudinal axis; wherein the at least one linkage is structured and arranged to maintain the first and second planes normally substantially parallel to the third plane, maintain the first, second and third planes to be never simultaneously collectively co-planar, maintain substantially parallel alignment among the first longitudinal axis, second longitudinal axis and third longitudinal axis; control vertical motion among the first longitudinal axis, second longitudinal axis and third longitudinal axis; maintain substantially fixed horizontal separation among the first longitudinal axis, second longitudinal axis and third longitudinal axis; permit rotation of the at least one first ski and the at least one second ski about an axis of rotation transverse to the third longitudinal axis; and permit cant between the at least one first ski relative to the at least one second ski.

In addition, this invention provides such system wherein the at least one linkage is structured and arranged to control vertical motion among the first longitudinal axis, second longitudinal axis and third longitudinal axis so that vertical motion of the first longitudinal axis is approximately equal and opposite to vertical motion of the second longitudinal axis relative to the third longitudinal axis. Further, it provides such a system wherein the at least one linkage is structured and arranged to impart motion to the at least one mounting assembly along the third longitudinal axis in response to vertical motion among the first longitudinal axis, second longitudinal axis and third longitudinal axis.

In still further addition, this invention further provides such system wherein the at least one linkage comprises: at least one double throw crank, the at least one double throw crank having at least one substantially co-linear shaft, a first free end parallel with the at least one substantially co-linear shaft and having a first offset from the at least one substantially co-linear shaft, and a second free end parallel with the at least one substantially co-linear shaft and having a second offset from the at least one substantially co-linear shaft; at least one first journal box structured and arranged to attach to the at least one first ski, the at least one first journal box being structured and arranged to receive the first free end of the at least one double throw crank; at least one second journal box structured and arranged to attach to the at least one second ski, the at least one second journal box being structured and arranged to receive the second free end of the at least one double throw crank; and at least one crank support box structured and arranged to attach to the at least one mounting assembly, the at least one crank support box being structured and arranged to receive the at least one substantially co-linear shaft in a position substantially transverse to the third longitudinal axis.

Further still, this invention further provides such system wherein the at least one linkage comprises: a solid double throw crank, the solid double throw crank having a shaft, a first free end parallel with the shaft and having a first offset from the shaft, and a second free end parallel with the shaft and having a second offset from the shaft; at least one first journal box structured and arranged to attach to the at least one first ski, the at least one first journal box being structured and arranged to receive the first free end of the solid double throw crank; at least one second journal box structured and arranged to attach to the at least one second ski, the second journal box being structured and arranged to receive the second free end of the solid double throw crank; and at least one bearing box structured and arranged to attach to the at least one mounting assembly, the at least one bearing box being structured and arranged to receive the shaft in a position substantially transverse to the third longitudinal axis. In addition, it provides such system wherein the at least one linkage comprises at least two linkages. And it provides such a system wherein the at least one linkage is structured and arranged to impart motion to the at least one mounting assembly along the third longitudinal axis in response to vertical motion among the first longitudinal axis, second longitudinal axis and third longitudinal axis; and also, wherein the at least one mounting assembly is structured and arranged to mount two boot bindings; and further, wherein the at least one bearing box is structured and arranged to attach to the at least one mounting assembly between locations for the two boot bindings.

Furthermore, this invention provides such a system wherein the at least one linkage comprises: an articulated double throw crank, the articulated double throw crank having a first shaft comprising a first gear, a first free end parallel with the first shaft and having a first offset from the first shaft, a second shaft comprising a second gear, a second free end parallel with the second shaft and having a second offset from the second shaft; at least one first journal box structured and arranged to attach to the at least one first ski, the at least one first journal box being structured and arranged to receive the first free end of the articulated double throw crank; at least one second journal box structured and arranged to attach to the at least one second ski, the second journal box being structured and arranged to receive the second free end of the articulated double throw crank; and at least one gearbox structured and arranged to attach to the at least one mounting assembly, the at least one gearbox being further structured and arranged to receive and house the first gear and the second gear in meshing relationship, with the first and second shafts in positions substantially transverse to the third longitudinal axis, so that the first free end and the second free end rotate about the gearbox in opposite directions.

In addition, it provides such a system wherein the at least one linkage comprises two linkages. And it provides such a system wherein the at least one linkage is structured and arranged to impart motion to the at least one mounting assembly along the third longitudinal axis in response to vertical motion among the first longitudinal axis, second longitudinal axis and third longitudinal axis; and also, wherein the at least one mounting assembly is structured and arranged to mount two boot bindings; and further, wherein the at least one gearbox is structured and arranged to attach to the at least one mounting assembly between locations for the two boot bindings.

Yet furthermore, this invention provides such a system wherein the at least one mounting assembly comprises, in combination: at least one sub-assembly structured and arranged to attach to the at least one linkage; attached to the sub-assembly, at least one rider assembly structured and arranged to provide at least one mounting for at least one boot binding; at least one connection bar structured and arranged to rotatably attach between the at least one rider assembly and the at least one sub-assembly, wherein the at least one rider assembly is permitted to rotate about an axis of rotation transverse to the third longitudinal axis; and at least one expansion system structured and arranged to apply separation force between the at least one rider assembly and the at least one sub-assembly. And, such system wherein the at least one expansion system is structured and arranged to be adjustable.

Still furthermore, this invention provides such a system wherein the at least one mounting assembly comprises, in combination: at least one sub-assembly structured and arranged to attach to the at least one linkage; attached to the sub-assembly, at least one rider assembly structured and arranged to provide at least one mounting for at least one boot binding; at least one connection bar structured and arranged to rotatably attach between the at least one rider assembly and the at least one sub-assembly, wherein the at least one rider assembly is permitted to rotate about an axis of rotation transverse to the third longitudinal axis; and at least one expansion system structured and arranged to apply separation force between the at least one rider assembly and the at least one sub-assembly.

Moreover, the present invention provides, in accordance with a preferred embodiment thereof, such an apparatus for linking at least one first ski lying substantially in a first plane and having a first longitudinal axis to at least one second ski lying substantially in a second plane and having a second longitudinal axis, comprising, in combination: at least one mounting assembly structured and arranged to mount at least one boot binding; and at least one linkage structured and arranged to link the at least one mounting assembly to and between the at least one first ski and the at least one second ski; the at least one mounting assembly lying normally in a substantially horizontal third plane above the first and second planes and having a third longitudinal axis; wherein the at least one linkage is structured and arranged to maintain the first and second planes normally substantially parallel to the third plane, maintain the first, second and third planes to be never simultaneously collectively co-planar, maintain substantially parallel alignment among the first longitudinal axis, second longitudinal axis and third longitudinal axis; control vertical motion among the first longitudinal axis, second longitudinal axis and third longitudinal axis; maintain substantially fixed horizontal separation among the first longitudinal axis, second longitudinal axis and third longitudinal axis; permit rotation of the at least one first ski and the at least one second ski about an axis of rotation transverse to the third longitudinal axis; permit cant between the at least one first ski relative to the at least one second ski.

In addition, this invention provides such apparatus wherein the at least one linkage is structured and arranged to control vertical motion among the first longitudinal axis, second longitudinal axis and third longitudinal axis so that vertical motion of the first longitudinal axis is approximately equal and opposite to the vertical motion of the second longitudinal axis relative to the third longitudinal axis. Further, it provides such apparatus wherein the at least one linkage is structured and arranged to impart motion to the at least one mounting assembly along the third longitudinal axis in response to vertical motion among the first longitudinal axis, second longitudinal axis and third longitudinal axis.

In still further addition, this invention further provides such apparatus wherein the at least one linkage comprises: at least one double throw crank, the at least one double throw crank having at least one substantially co-linear shaft, a first free end parallel with the at least one substantially co-linear shaft and having a first offset from the at least one substantially co-linear shaft, and a second free end parallel with the at least one substantially co-linear shaft and having a second offset from the at least one substantially co-linear shaft; at least one first journal box structured and arranged to attach to the at least one first ski, the at least one first journal box being structured and arranged to receive the first free end of the at least one double throw crank; at least one second journal box structured and arranged to attach to the at least one second ski, the at least one second journal box being structured and arranged to receive the second free end of the at least one double throw crank; and at least one crank support box structured and arranged to attach to the at least one mounting assembly, the at least one crank support box being structured and arranged to receive the at least one substantially co-linear shaft in a position substantially transverse to the third longitudinal axis.

Further still, this invention further provides such apparatus wherein the at least one linkage comprises: a solid double throw crank, the solid double throw crank having a shaft, a first free end parallel with the shaft and having a first offset from the shaft, and a second free end parallel with the shaft and having a second offset from the shaft; at least one first journal box structured and arranged to attach to the at least one first ski, the at least one first journal box being structured and arranged to receive the first free end of the solid double throw crank; at least one second journal box structured and arranged to attach to the at least one second ski, the second journal box being structured and arranged to receive the second free end of the solid double throw crank; and at least one bearing box structured and arranged to attach to the at least one mounting assembly, the at least one bearing box being structured and arranged to receive the shaft in a position substantially transverse to the third longitudinal axis. In addition, it provides such apparatus wherein the at least one linkage comprises at least two linkages. And it provides such apparatus wherein the at least one linkage is structured and arranged to impart motion to the at least one mounting assembly along the third longitudinal axis in response to vertical motion among the first longitudinal axis, second longitudinal axis and third longitudinal axis; and also, wherein the at least one mounting assembly is structured and arranged to mount two boot bindings; and further, wherein the at least one bearing box is structured and arranged to attach to the at least one mounting assembly between locations for the two boot bindings.

Furthermore, this invention provides such apparatus wherein the at least one linkage comprises: an articulated double throw crank, the articulated double throw crank having a first shaft comprising a first gear, a first free end parallel with the first shaft and having a first offset from the first shaft, a second shaft comprising a second gear, a second free end parallel with the second shaft and having a second offset from the second shaft; at least one first journal box structured and arranged to attach to the at least one first ski, the at least one first journal box being structured and arranged to receive the first free end of the articulated double throw crank; at least one second journal box structured and arranged to attach to the at least one second ski, the second journal box being structured and arranged to receive the second free end of the articulated double throw crank; and at least one gearbox structured and arranged to attach to the at least one mounting assembly, the at least one gearbox being further structured and arranged to receive and house the first gear and the second gear in meshing relationship, with the first and second shafts in positions substantially transverse to the third longitudinal axis, so that the first free end and the second free end rotate about the gearbox in opposite directions.

In addition, it provides such apparatus wherein the at least one linkage comprises two linkages. And it provides such apparatus wherein the at least one linkage is structured and arranged to impart motion to the at least one mounting assembly along the third longitudinal axis in response to vertical motion among the first longitudinal axis, second longitudinal axis and third longitudinal axis; and also, wherein the at least one mounting assembly is structured and arranged to mount two boot bindings; and further, wherein the at least one gearbox is structured and arranged to attach to the at least one mounting assembly between locations for the two boot bindings.

Yet furthermore, this invention provides such apparatus wherein the at least one mounting assembly comprises, in combination: at least one sub-assembly structured and arranged to attach to the at least one linkage; attached to the sub-assembly, at least one rider assembly structured and arranged to provide at least one mounting for at least one boot binding; at least one connection bar structured and arranged to rotatably attach between the at least one rider assembly and the at least one sub-assembly, wherein the at least one rider assembly is permitted to rotate about an axis of rotation transverse to the third longitudinal axis; and at least one expansion system structured and arranged to apply separation force between the at least one rider assembly and the at least one sub-assembly. And, such apparatus wherein the at least one expansion system is structured and arranged to be adjustable.

Still furthermore, this invention provides such apparatus wherein the at least one mounting assembly comprises, in combination: at least one sub-assembly structured and arranged to attach to the at least one linkage; attached to the sub-assembly, at least one rider assembly structured and arranged to provide at least one mounting for at least one boot binding; at least one connection bar structured and arranged to rotatably attach between the at least one rider assembly and the at least one sub-assembly, wherein the at least one rider assembly is permitted to rotate about an axis of rotation transverse to the third longitudinal axis; and at least one expansion system structured and arranged to apply separation force between the at least one rider assembly and the at least one sub-assembly.

DETAILED DESCRIPTION OF A PREFERRED EMBODIMENT AND THE BEST MODE OF PRACTICE

Figure 1:
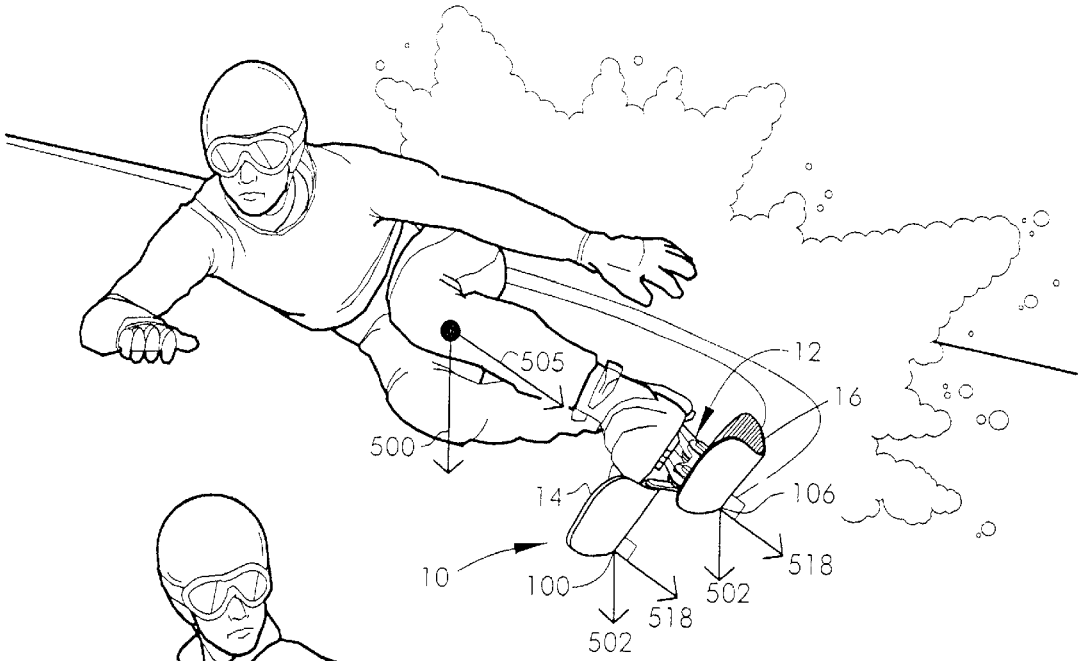
FIG. 1 is an artistic rendering of a preferred embodiment of the present invention in use by a skier in the execution of a turn.

FIG. 1 is an artistic rendering of a skier enjoying a preferred embodiment of the snowboard system 10 of the present invention. The linkage system 12 is illustrated coordinating the motions of linked skis 14 and 16 to property align edges 100 and 106, and permit the skier to carve a turn. As used herein, "snow" is understood to be precipitation in the form of ice crystals. These ice crystals may be loose, providing for powdered snow, tightly packed to form solid ice, or some state in-between.

As discussed herein, skis 14 and 16 are preferably alpine in style; however, under appropriate circumstances and the preferences of the skier, all styles of skis and snowboards may be substituted.

Figure 2:
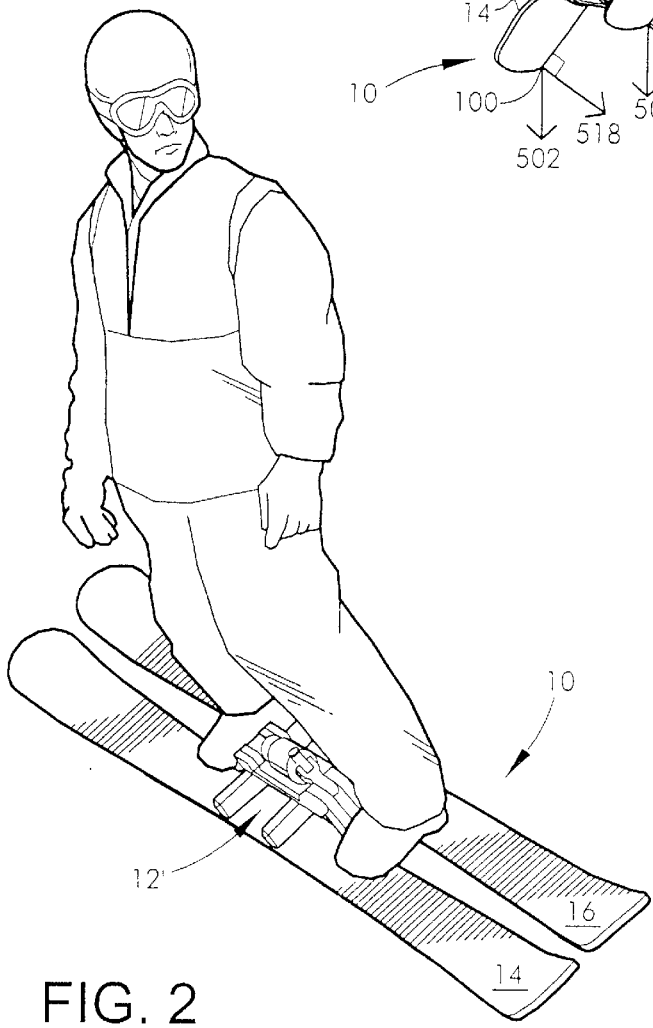
FIG. 2 is an artistic rendering of a second preferred embodiment of the present invention in use by a skier, showing more clearly, the placement of the linkage system.

FIG. 2 is an artistic rendering of a skier enjoying the snowboard system 10, and more specifically, the preferred placement of the connection linkage 12, linking and coordinating the motion of skis 14 and 16, as taught under the present invention, substantially between the feet of the skier. As shown, the skier's feet are placed fore and aft of the connection linkage 12, and the skier is riding above skis 14 and 16.

Figure 3:
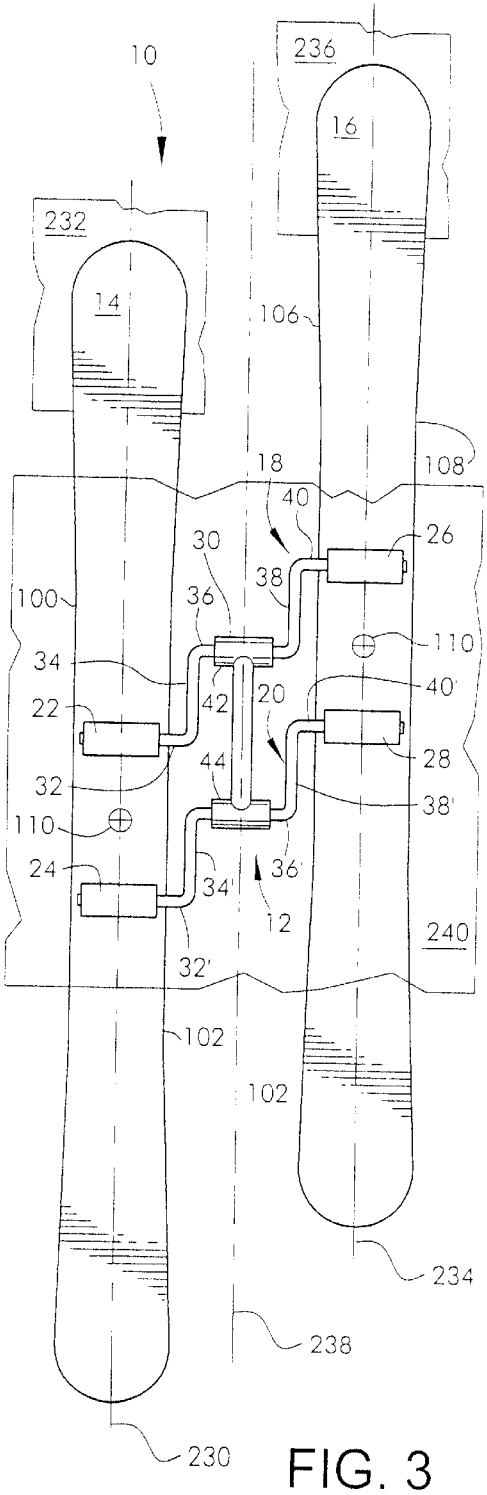
FIG. 3 is a schematic illustration of a preferred embodiment of the present invention, linking two skis with two solid double throw crank assemblies.

FIG. 3 schematically illustrates a snowboard system 10, and more specifically, the connection linkage system 12. As shown, each ski comprises an outside edge 100 and 108, an inside edge 102 and 106, and longitudinal axes 230 and 234 lying substantially in a plane as defined by outside edge 100, inside edge 102 and axis 230 for ski 14, and outside edge 108, inside edge 106 and axis 234 for ski 16 (embodying herein at least one first ski lying substantially in a first plane and having a first longitudinal axis; at least one second ski lying substantially in a second plane and having a second longitudinal axis).

Such a system and linkage maintains the two skis 14 and 16, when at rest, in a substantially co-planar, parallel position, and permits vertical and pivotal movement of the skis relative to each other. When at rest, in a normally horizontal position, the main assembly 30 rests in a plane 240 elevationally above, and parallel to, the plane 232 of the first ski 14, and the plane 236 of the second ski 16 (embodying herein at least one mounting assembly lying normally in a substantially horizontal third plane above the first and second planes and having a third longitudinal axis). As used herein, the term "parallel" is understood to permit co-planar existence between the two skis and/or between any one ski and the main assembly 30. The plane 240 of the main assembly 30 and the planes 232 and 236 of the skis 14 and 16 are never simultaneously collectively co-planar (embodying herein at least one linkage structured and arranged to maintain the first and second planes normally substantially parallel to the third plane, maintain the first, second and third planes to be never simultaneously collectively co-planar).

The skis 14 and 16 are interconnected by a linkage system 12. Preferably, the linkage system 12 is comprised of double throw cranks 18 and 20, journal boxes 22 and 24 mounted to the ski 14, journal boxes 26 and 28 mounted to the ski 16, and a main assembly 30 (embodying herein at least one linkage structured and arranged to link the at least one mounting assembly to and between the at least one first ski and the at least one second ski). Double throw cranks 18 and 20 are preferably solid double throw cranks, each double throw crank having a first free end 32 and 32', a first offset 34 and 34', a shaft 36 and 36', a second offset 38 and 38', and a second free end 40 and 40' (embodying herein a solid double throw crank, the solid double throw crank having a shaft, a first free end parallel with the shaft and having a first offset from the shaft, and a second free end parallel with the shaft and having a second offset from the shaft).

As shown, free ends 32 and 32' of double throw cranks 18 and 20 overlie ski 14 in an area proximate to the ski manufacturer's intended "center" point 110 (and preferred location for binding attachment). Free ends 32 and 32' are engaged by journal boxes 22 and 24 mounted to ski 14 (embodying herein at least one first journal box structured and arranged to attach to the at least one first ski, the at least one first journal box being structured and arranged to receive the first free end of the double throw crank). Free ends 40 and 40' of double throw cranks 18 and 20 also overlie ski 16 in an area preferably proximate to the ski manufacturer's indicated "center" point 110 (and preferred location for binding attachment), and are engaged by journal boxes 26 and 28 mounted to ski 16 (embodying herein at least one second journal box structured and arranged to attach to the at least one second ski, the second journal box being structured and arranged to receive the second free end of the double throw crank). Main assembly 30 preferably incorporates at least one crank support box, preferably bearing boxes 42 and 44, to preferably permit firm attachment to the respective shafts 36 and 36' of double throw cranks 18 and 20, while permitting shafts 36 and 36' to rotate freely about the longitudinal axis of shafts 36 and 36'. As shown, double throw cranks 18 and 20 are attached to main assembly 30 such that shafts 36 and 36' are preferably substantially transverse to the longitudinal axis 238 of main assembly 30 (at least one bearing box structured and arranged to attach to the at least one mounting assembly, the at least one bearing box being structured and arranged to receive the shaft in a position substantially transverse to the third longitudinal axis). It is noted that shafts 36 and 36' are not required to intersect axis 238 (see FIG. 5). Main assembly 30 further preferably incorporates mounting elements (see FIG. 5) for preferably attaching bindings to receive the rider's boots.

In a preferred embodiment of the invention, with respect to double throw crank 18, free end 32 is perpendicular (meaning herein "substantially perpendicular" to an extent that theoretical behavior will approximate closely real behavior) to first offset 34, first offset 34 is perpendicular to shaft 36, shaft 36 is perpendicular to second offset 38, and second offset 38 is perpendicular to free end 40. All components are preferably substantially rigidly affixed, one to another, and are co-planar. Likewise, with respect to double throw crank 20, free end 32' is perpendicular to first offset 34', first offset 34' is perpendicular to shaft 36', shaft 36' is perpendicular to second offset 38', and second offset 38' is perpendicular to free end 40'. All components are rigidly affixed, one to another, and are co-planar. As shown, preferably, double throw cranks 18 and 20 are substantially identical and symmetrical such that offsets 34, 34', 38, and 38' are substantially equal. As shown, under a preferred embodiment of the invention, there are two double throw cranks comprising the linkage assembly 12 (embodying herein the at least one linkage comprising at least two of the linkages). Preferably, double throw cranks 18 and 20 include substantially right angles between the different portions thereof. If angles other than right angles are used, the skis may become splayed or stemmed as they move vertically. Under appropriate circumstances, one may permit increased resiliency in double throw cranks 18 and 20 by using offsets comprised substantially of spring steel. It is likewise preferable that journal boxes 22 and 24 are mounted substantially transverse to the longitudinal axis 230 of ski 14, and journal boxes 26 and 28 are mounted substantially transverse to the longitudinal axis 234 of ski 16.

The perpendicular alignment of the journal boxes 22, 24, 26 and 28, with respect to axes 230 and 234, and right angle structure of double throw cranks 18 and 20, ensures that as between axis 230 of ski 14, axis 238 of main assembly 30, and axis 234 of ski 16, the relative horizontal distance of separation remains fixed (embodying herein linkage structured and arranged to maintain substantially fixed horizontal separation among the first longitudinal axis, second longitudinal axis and third longitudinal axis). Thus, it is seen that linkage system 12 is structured and arranged to maintain fixed horizontal separation among the longitudinal axes of the skis (and the main assembly for holding the bindings). While the elevation of one ski relative to the other may change, the relative horizontal distance of separation between the skis is preferably maintained as a constant.

Figure 4:
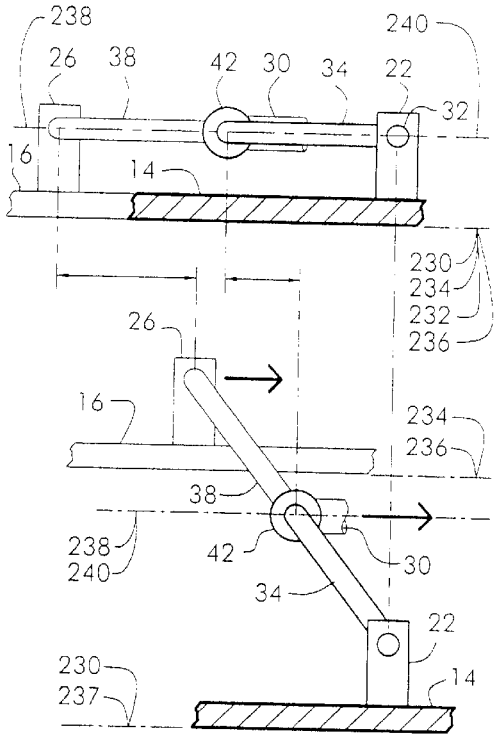
FIG. 4 is a partial side schematic illustration of the solid double throw crank arm embodiment illustrating the horizontal movement of the main assembly relative to at least one ski.

As shown in the partial sectional view of FIG. 4, the main assembly 30 of linkage 12 is normally (see upper part of FIG. 4) elevationally above the top surface of the skis 14 and 16, and more specifically, not in contact with the snow (not shown). It may be further observed that in this normal state, axes 230 and 234 and their respective planes 232 and 236 of skis 14 and 16 are co-planar, and elevationally below axis 280 in parallel plane 240 of main assembly 30 (embodying herein linkage structured and arranged to maintain substantially parallel alignment among the first longitudinal axis, second longitudinal axis and third longitudinal axis). As ski 16 is raised elevationally with respect to ski 14, free ends 32, 32' and 40, 40' of respective double throw cranks 18 and 20 rotate within respective journal boxes 22, 26, and 24, 28. Shafts 36 and 36' likewise rotate within bearing boxes 42 and 44. By means of such rotation and the substantially equal lengths of offsets 34, 34', 38 and 38', vertical motion among axes 230, 234 and 240 is coordinated, and substantially parallel orientation of skis 14 and 16 and main assembly 30 is maintained (embodying herein linkage structured and arranged to control vertical motion among the first longitudinal axis, second longitudinal axis and third longitudinal axis so that vertical motion of the first longitudinal axis is approximately equal and opposite to vertical motion of the second longitudinal axis relative to the third longitudinal axis). As shown in the lower part of FIG. 4, with respect to ski 14, there is a horizontal rearward and forward motion of main assembly 30 along its axis 238 as a direct result of the permitted vertical motion (embodying herein linkage structured and arranged to impart motion to the at least one mounting assembly along the third longitudinal axis in response to vertical motion among the first longitudinal axis, second longitudinal axis and third longitudinal axis).

In the process of skiing and/or snowboarding, the skier preferably experiences both linear motion along the longitudinal axes 230 and 234 of the skis 14 and 16 (i.e., he or she travels to where he or she desires to go), and vertical motion between skis 14 and 16 felt in the process of turning (discussed in greater detail with respect to FIGS. 11, 12 and 13 below). Preferably, the skier does not experience the feel or sensation of skis 14 and 16 being forced horizontally toward or away from one another with respect to their axis, for such motion is transverse to the desired linear motion, and likely to frustrate smooth linear motion.

The preferred rotary motion of the linkage 12 transverse to the axes 230 and 234 permits rotation of the skis 14 and 16 about an axes of rotation transverse to axis 238 of the main assembly 30 (embodying herein linkage structured and arranged to permit rotation of the at least one first ski and the at least one second ski about an axis of rotation transverse to the third longitudinal axis). Because of the forward and rearward motion of the main assembly 30, to which mounting elements are attached for preferably attaching bindings to receive the skier's boots, the skier feels only the linear motion of the skis (carrying the skier in the desired direction) and the relative vertical motion of the skis 14 and 16. This is an important and preferred advantage of the described embodiments of the present invention because the feel transmitted to the skier is familiar and natural.

Figure 5:
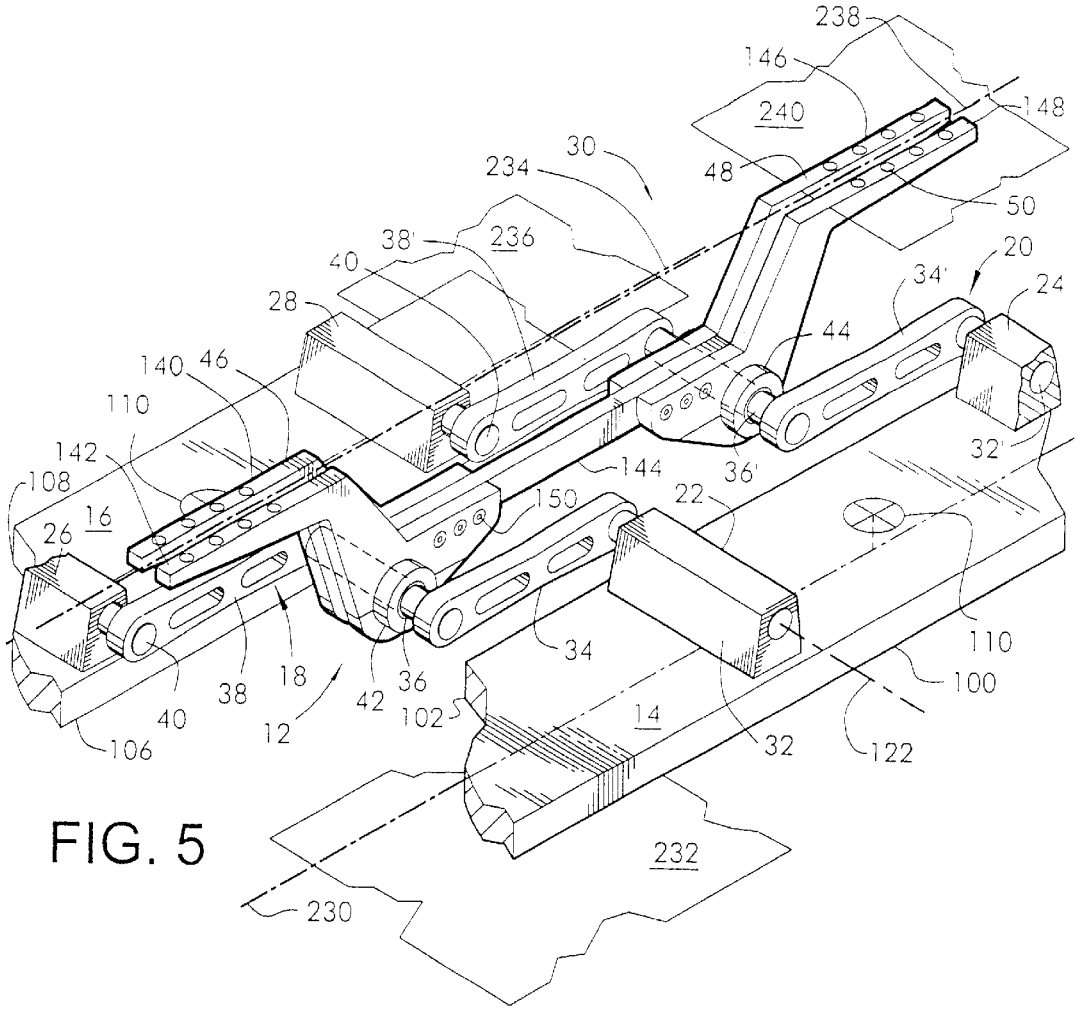
FIG. 5 is a detailed perspective view, partially in section, illustrating the solid double throw crank arm embodiment.

FIG. 5 is a partial view of skis 14 and 16 showing the linkage system 12, and more completely, depicting the assembly of double throw crank 18, preferably comprised of free end 32, first offset 34, shaft 36, second offset 38 and second free end 40, and double throw crank 20, preferably comprised of free end 32', first offset 34', shaft 36', second offset 38' and second free end 40'. Also shown are mounting elements 46 and 48 (for bindings for the rider) as they are preferably incorporated into the main assembly 30 (embodying herein at least one mounting assembly structured and arranged to mount two boot bindings). Struts 140 and 142 comprise mounting element 46, and preferably, incorporate bearing 42 to permit free rotation about shaft 36. Struts 146 and 148 comprise mounting element 48, and, preferably, incorporate bearing 44 (as shown) to permit free rotation about shaft 36'. Mounting elements 46 and 48 are preferably rigidly attached to cross member 144, and are thereby preferably interconnected by bolts 150. Preferably, struts 140, 142, 146 and 148 are constructed to raise the point of binding attachment for the rider to an elevation such that the rider's boot will not impede full rotation of double throw cranks 18 and 20. Skiers of different sizes, weights, and ability will require different boot bindings; however, for increased marketability, there is a general preferred standard for the location of mounting holes set to receive mounting screws for boot bindings. Preferably, mounting elements 46 and 48 are fashioned to provide these preferred mounting holes 50.

In the preferred embodiment, mounting elements 46 and 48 are constructed such that bearings 42 and 44 are between the mounting elements set to receive the boot bindings (embodying herein at least one bearing box is structured and arranged to attach to the at least one mounting assembly between locations for the two boot bindings). When one ski is at the maximum point of elevation above the other, preferably, double throw cranks 18 and 20 will be perpendicular in orientation relative to each ski. In such configuration, it can be most easily appreciated that journal boxes 22, 24, 26 and 28 apply the skier's weight to the skis at a point between the skier's boots. More specifically, as discussed, the skier's weight is applied to the skis substantially proximate to the binding attachment points intended by the ski manufacturer. Conventionally, when snowboarding, the stance of the skier is such that his or her weight is applied to the fore and aft section of the board, and not to the middle. Should this stance be applied directly to a ski, the application of weight is not proximate to the binding attachment points intended by the ski manufacturer 110.

Figure 6:
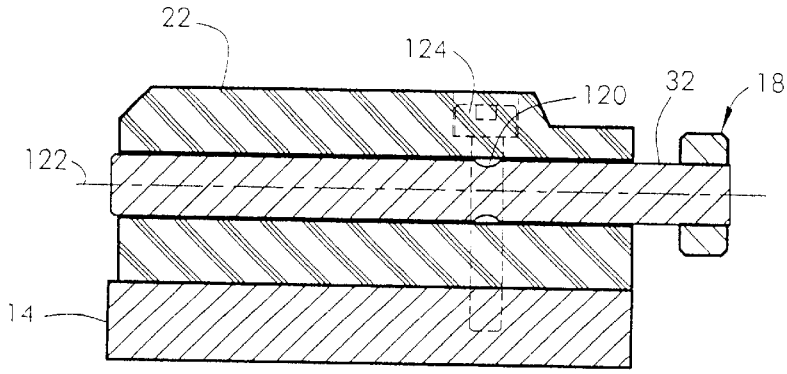
FIG. 6 is a detailed sectional view of a journal box showing the preferred means of restraining the free end of a crank.

FIG. 6 is a partial cross-sectional view of a ski 14 showing journal box 22 securing free end 32. As shown, free end 32 preferably has a circumferential notch 120 perpendicular to central axis 122. Preferably, the radius of curvature of notch 120 is substantially identical to the radius of curvature comprising the shaft of bolt 124. Preferably, free end 32 is inserted into journal box 14, and bolt 124 is then inserted and tightened to further bind journal box 22 to ski 14. Preferably, the matched curvature of notch 120 in free end 32 against bolt 124 secures free end 32, while still permitting rotation of free end 32 about axis 122, and thereby the rotation of crank 18. Under appropriate circumstances, it may be desired to have two or more such bolt 124 and notch 120 arrangements to more completely restrain the free end of the crank and ensure firm attachment and transverse configuration of journal box 22 to ski 14. Preferably, journal box 22 is manufactured from thermoplastic material, preferably, with sufficient bearing properties incorporated to provide durability and ease of rotation. For simplicity of design and ease of assembly, preferably, the configuration herein described of securing free end 32 within journal box 22 is applied to all free ends and ski-mounted journal boxes. Under appropriate circumstances, bearing components to improve rotation properties may be incorporated. It is to be understood that, under appropriate circumstances, those skilled in the art of ski equipment manufacture may prefer C-clips or other securing means to restrain free end 32.

Figure 7:
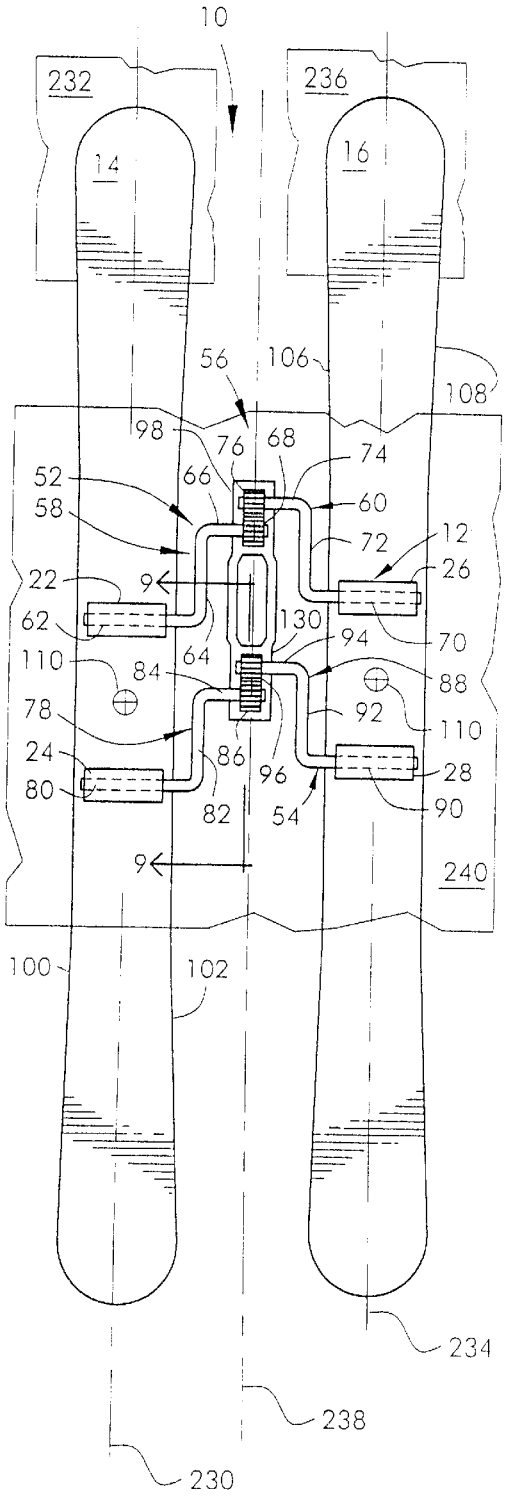
FIG. 7 is a schematic illustration of a preferred embodiment of the present invention linking two skis with two geared crank assemblies.

FIG. 7 schematically illustrates a snowboard system 10, and more specifically, a connection linkage system 12' utilizing a set of counter-rotating gears. Such a system and linkage maintains the two skis 14 and 16, when at rest, in a substantially co-planar, parallel position, and permits vertical and pivotal movement of the skis relative to each other. As shown, two skis 14 and 16 are interconnected by a linkage system 12' comprised of geared cranks 52 and 54, journal boxes 22 and 24 mounted to ski 14, journal boxes 26 and 28 mounted to ski 16, and main geared assembly 56 (embodying herein the at least one linkage comprising at least two of the linkages).

As shown, geared crank 52 is comprised of two throw arms 58 and 60. Respectively, throw arm 58 has a free end 62 perpendicularly connected to offset 64. Offset 64 is, in turn, perpendicularly connected to shaft 66. Gear 68 is attached to shaft 66. Throw arm 60 has free end 70 perpendicularly connected to offset 72. Offset 72 is, in turn, perpendicularly connected to shaft 74. Gear 76 is attached to shaft 74 (embodying herein an articulated double throw crank, the articulated double throw crank having a first shaft comprising a first gear, a first free end parallel with the first shaft and having a first offset from the first shaft, a second shaft comprising a second gear, a second free end parallel with the second shaft and having a second offset from the second shaft). Gear 76 meshes with gear 68, both of which are contained in at least one crank support box, preferably, at least one gearbox incorporated in the main geared assembly 56. By means of the gears 76 and 68, the motion of throw arms 58 and 60 are coordinated. More specifically, a downward motion of free end 70 of throw arm 60 will result in a corresponding upward motion of free end 62 of throw arm 58, and vice-versa. This relationship of motion, as directed by the gears 68 and 76, is more completely illustrated in FIGS. 8 and 9.

Geared crank 54 is, likewise as shown, comprised of two throw arms 78 and 88, respectively. Throw arm 78 has a free end 80 perpendicularly connected to offset 82. Offset 82 is, in turn, perpendicularly connected to shaft 84. Gear 86 is attached to shaft 84. Throw arm 88 has free end 90 perpendicularly connected to offset 92. Offset 92 is, in turn, perpendicularly connected to shaft 94. Gear 96 is attached to shaft 94. Gear 96 meshes with gear 86, both of which are contained in a gearbox incorporated in the main geared assembly 56. Preferably, gears 56, 68, 86 and 96 incorporate stops to prevent rotation beyond 90 degrees.

As with the solid double throw cranks 18 and 20 discussed above, the respective components (end, offset, shaft, etc.) comprising each respective throw arm 58, 60, 78 and 88 are preferably rigidly affixed, one to another, and are co-planar. The angles of alignment between the throw arm components are preferably substantially right angles. Under appropriate circumstances, it may be preferred to permit increased resiliency in geared cranks 52 and 54 by using offsets comprised substantially of spring steel. If angles other than right angles are used, the skis can become splayed or stemmed as they move vertically, one to another.

As shown, free ends 62 and 80 of geared cranks 52 and 54 overlie ski 14 in an area proximate to the ski manufacturer's intended "center" point 110 (and preferred location for binding attachment). Free ends 62 and 80 are engaged by journal boxes 22 and 24 mounted to ski 14. Free ends 70 and 90 of geared cranks 52 and 54 overlie ski 16 in an area preferably proximate to the ski manufacturer's indicated "center" point 110 (and preferred location for binding attachment), and are engaged by journal boxes 26 and 28 mounted to ski 16.

Main geared assembly 56 preferably incorporates gearbox 98 to preferably hold and permit proper meshing of gears 56 and 68, and gearbox 130 to preferably hold and permit proper meshing of gears 86 and 96. By incorporating gearboxes 98 and 130 within the structure of main geared assembly 56, main geared assembly 56 is preferably firmly attached to geared cranks 52 and 54, while preferably permitting each to rotate about the axis of the meshed gears. As shown, geared cranks 52 and 54 are attached to the main geared assembly 56 by gearboxes 98 and 130 such that shafts 66, 74, 84 and 94 are preferably substantially transverse to longitudinal axis 238 of main geared assembly 56 (embodying herein at least one gearbox structured and arranged to attach to the at least one mounting assembly, the at least one gearbox being further structured and arranged to receive and house the first gear and the second gear in meshing relationship, with the first and second shafts in positions substantially transverse to the third longitudinal axis, so that the first free end and the second free end rotate about the gearbox in opposite directions). As with the solid double throw cranks 18 and 20 discussed above, it is noted that shafts are not required to intersect axis 238. Main assembly 56 further preferably incorporates mounting elements for preferably attaching bindings to receive the rider's boots.

It is, likewise, important that journal boxes 22 and 24 are mounted substantially transverse to the longitudinal axis 230 of ski 14, and journal boxes 26 and 28 are mounted substantially transverse to the longitudinal axis 234 of ski 16.

The perpendicular alignment of the journal boxes 22, 24, 26 and 28, with respect to axes 230 and 234, and right angle structure of geared cranks 52 and 54, ensures that in between axis 230 of ski 14, axis 238 of main geared assembly 56, and axis 234 of ski 16, the relative horizontal distance of separation remains fixed (embodying herein linkage structured and arranged to maintain substantially fixed horizontal separation among the first longitudinal axis, second longitudinal axis and third longitudinal axis). While the elevation of one ski relative to the other may change, the relative horizontal distance of separation between the skis is preferably maintained as a constant. Preferably, the free ends 62, 70, 80 and 90 are restrained within corresponding journal boxes 22, 26, 24 and 28 by means substantially identical to the bolt and groove system described above with respect to FIG. 6.

Figure 8:
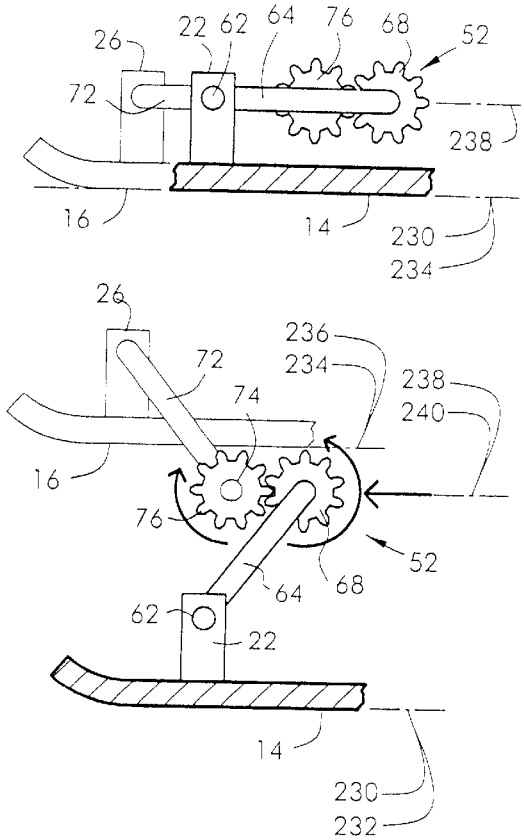
FIG. 8 is a partial side schematic illustration of the geared crank arm embodiment illustrating the motion of the geared crank components.
Figure 9:
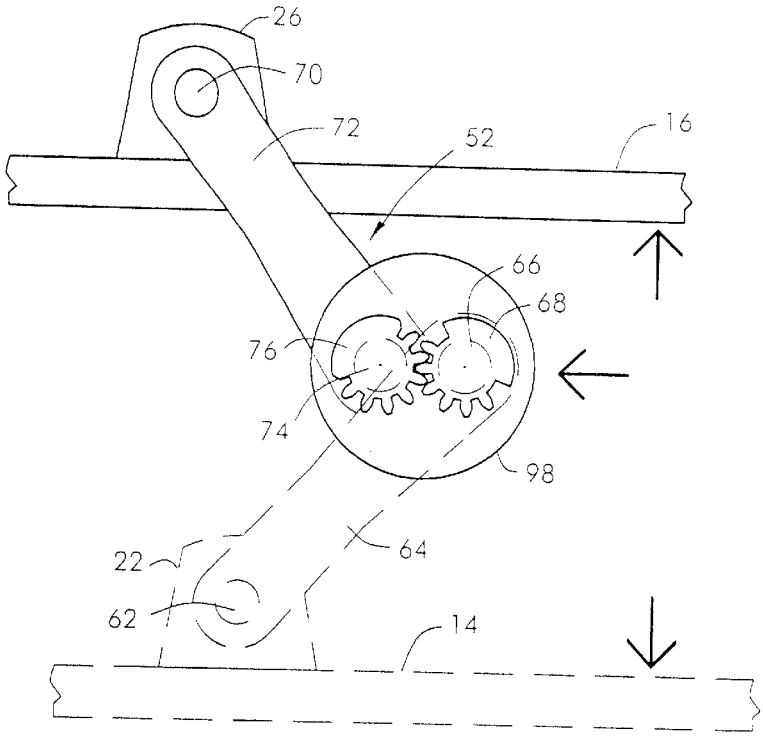
FIG. 9 is a partial sectional view illustrating the geared crank arm embodiment and the motion of the geared crank components.

The relative motion of the skis and main geared assembly is shown in FIGS. 8 and 9. FIG. 8 (upper part) schematically illustrates the initial condition of the skis as co-planar. The main geared assembly 56, comprised in part of depicted geared crank 52, is initially elevationally above the top surface of the skis 14 and 16, and more specifically, is thus not in contact with the snow. As illustrated in the bottom part of FIG. 8, as ski 16 moves vertically with respect to ski 14, gear 76 preferably rotates clockwise, causing gear 68 to rotate counterclockwise.

For ease of illustration, only geared crank 52 is depicted in FIG. 8, and in greater detail in FIG. 9; however, it is understood that the movement of components and rotation of gears herein described applies equally to geared crank 54, and the main geared assembly 56 as a whole. There is a preferred direct substantially horizontal rearward and forward motion of the gears 76 and 68 as they are contained within gearbox 98, incorporated within main geared assembly 56 with respect to both skis 14 and 16.

As noted in the above, in the process of skiing and/or snowboarding, the skier preferably experiences both linear motion along the longitudinal axes 230 and 234 of the skis 14 and 16, and vertical motion between skis 14 and 16, felt in the process of turning. More specifically, the skier travels in the direction he or she desires, and feels a vertical roll in the skis or snowboard as he or she turns. Preferably, the skier does not experience the feel or sensation of skis 14 and 16 being forced horizontally toward or away from one another with respect to their axis, for such motion is transverse to the desired linear motion of travel, and likely to frustrate smooth skiing. More specifically, if skis 14 and 16 are forced toward or away from one another with respect to their axes 230 and 234, one or more of the respective edges 100, 106, and 102, 108 will be forced to scrape across the surface of the snow in a direction transverse to the intended direction of travel.

Because of the forward and rearward motion of the main geared assembly 56, to which mounting elements are attached for preferably attaching bindings to receive the skier's boots, the skier feels only the linear motion of the skis 14 and 16 (carrying the skier in the desired direction), and the relative vertical motion of the skis 14 and 16. The preferred rotary motion of the linkage 12' transverse to the axes 230 and 234, and thereby to the desired direction of travel, ensures the constant relative horizontal separation among the longitudinal axes 230 and 234 of skis 14 and 16, and the axis 238 of the main geared assembly 56. This is an important and preferred advantage of the described embodiments of the present invention because the feel transmitted to the skier is familiar and natural.

In the practice of skiing down a snow-covered slope, rarely will the terrain be completely smooth. When skiing on two skis it is normal, and in fact expected, that the skis, which are traveling parallel to one another, will at times, cant, as one ski passes over a hump or through a depression that is not encountered by the other. As such, it is to be expected that although substantially parallel in overall direction of travel, the tip of one ski may be substantially above or below the tail of that same ski, and overall, the canted ski may be elevationally above or below the second ski. More specifically, one ski is inclined or declined relative to the other, as in being canted.

Figure 10:
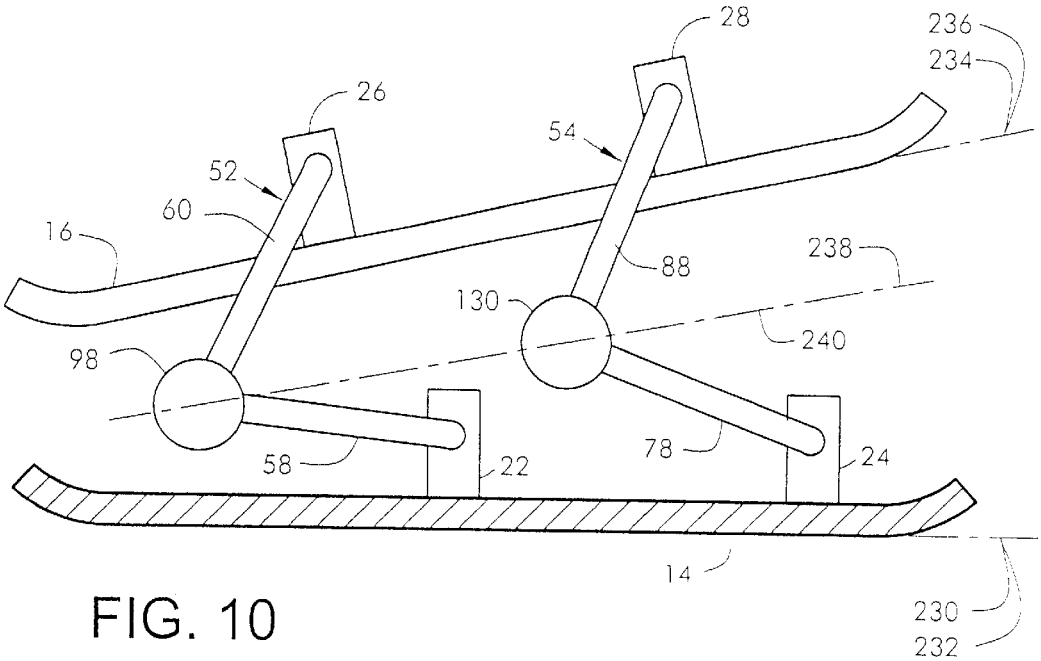
FIG. 10 is a schematic illustration of a preferred embodiment of the present invention linking two skis with two geared crank assemblies, illustrating cant ability between the skis.

FIG. 10 illustrates how applicant's present invention embodying geared cranks 52 and 54 easily and substantially permits the canting of skis 14 and 16. With reference to the motion depicted in FIGS. 8 and 9, as shown in FIG. 10, throw arms 88 and 78, as interconnected through gearbox 130 of geared crank 54, have rotated more substantially than throw arms 60 and 58, as interconnected through gearbox 98 of geared crank 52. As a result, the relative vertical difference between the tips of skis 14 and 16 is not as great as the relative vertical difference between the tails of skis 14 and 16 (embodying herein linkage structured and arranged to permit cant between the at least one first ski relative to the at least one second ski). In permitting this preferred cant ability, the preferred rotary motion of geared cranks 52 and 54 ensures that the relative horizontal distance of separation between skis 14 and 16 is uniform and maintained. Such cant ability is preferred by skiers wishing to ski rough terrain. Such cant ability is enjoyed, but to a lesser extent, by riders using the solid double throw crank embodiment, as well.

Figure 11:
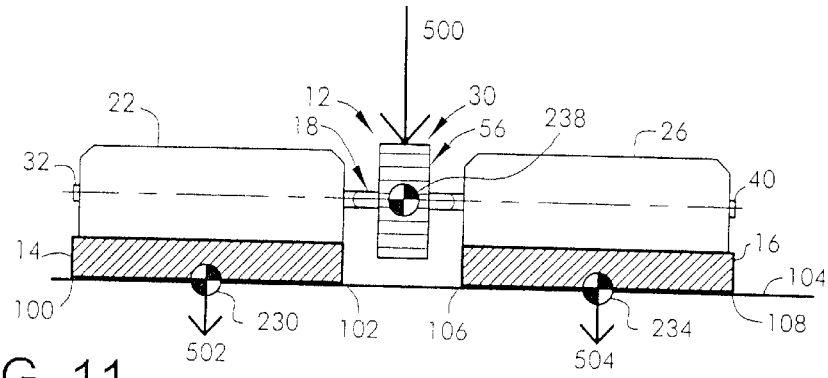
FIG. 11 is a schematic illustration of a preferred embodiment of the present invention linking two skis and illustrating the relative transfer of force when at rest.
Figure 12:
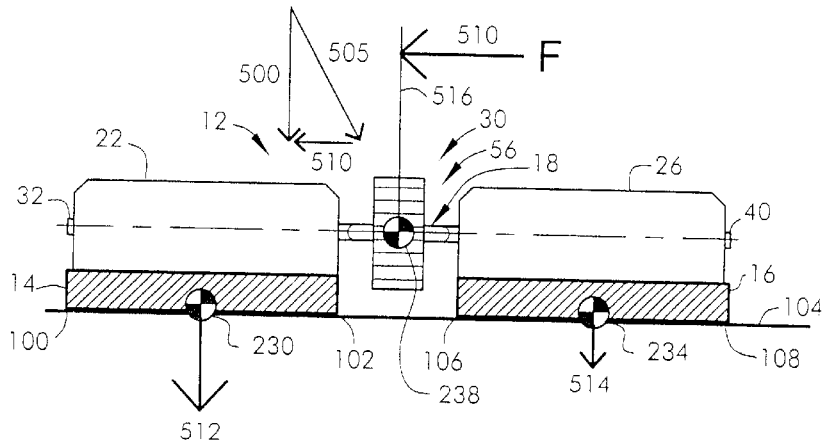
FIG. 12 is a schematic illustration of a preferred embodiment of the present invention linking two skis and illustrating the relative unequal transfer of force when the skier applies non-perpendicular force to initiate a turn.
Figure 13:
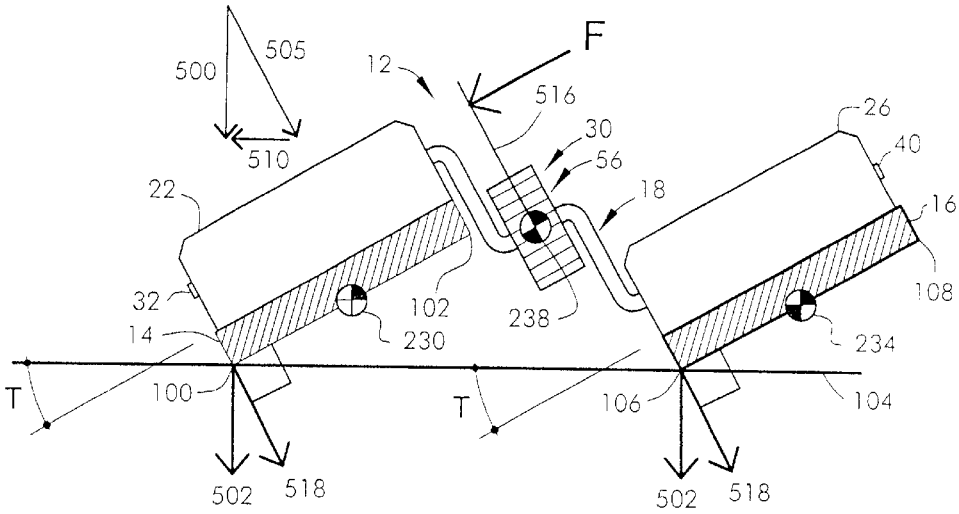
FIG. 13 is a schematic illustration of a preferred embodiment of the present invention linking two skis and illustrating the relative balance of force achieved when the perpendicular axis of the present invention is aligned with the applied turning force.

FIGS. 11, 12, and 13 illustrate the transfer of force and the symmetry of motion enabled by all illustrated embodiments of the present invention. The initial state is depicted by FIG. 11. Here, the weight/force of the skier 500 is applied directly down upon the main assembly 30, or main geared assembly 56, if the embodiment of geared cranks 52 and 54 is employed. The transfer of force and weight, as performed by the solid double throw crank embodiment and the geared crank assembly embodiment, is substantially the same. For ease of discussion only, the following description is provided with respect to the solid double throw crank arm 18 and is understood to apply equally to geared crank arm 52.

The force 500, as applied to the main assembly 30, is distributed through the linkage system 12 and transferred to skis 14 and 16 by means of free ends 32 and 40 held by journal boxes 22 and 26, respectively. As the system is at rest, the weight force of the skier is preferably substantially equally distributed to each ski 14 and 16, as indicated by relative equal force arrows 502 and 504.

The process of initiating a turn has been discussed above at some length. In summary, the skier transfers his or her weight to the edge of the ski closest to the inside of the turn. Preferably, the transfer of weight is achieved by the skier moving his or her center of gravity from a point directly above the main assembly 30 and in line with axis 238, toward the direction he or she wishes to turn. This transfer of weight results in applied force 505. Simplistically stated, the force is now applied with both a perpendicular 500 and lateral 510 component. With respect to the skis, the application of force is moved from a uniform distribution across the bottom of each ski to a concentration of force upon the edge of the ski, thus, causing the ski to rotate about the edge. The process is commonly referred to as "rolling the edge of the ski".

As the skier is attached only to the main assembly 30, the displaced center of gravity results in a lateral rotational force applied to main assembly 30, about axis 238. As shown in FIG. 12, this increased lateral force 510 results in an increase of loading force 512 upon ski 14, particularly upon the outside edge 100 of ski 14, and a decrease of loading force upon ski 16. As free end 40 of double throw crank 18 acts as a lever to transfer the torsional force as applied to the main assembly 30 to ski 14, and specifically, the outside edge 100 of the ski 14, there is a natural tendency for ski 14 to roll about edge 100. As this roll is accomplished, the inside edge 102 of ski 14 will rise elevationally with respect to the contact point of edge 100 and the snow surface 104. Mirroring the lever action imparted against the outside edge 100 of ski 14, free end 40 of double throw crank 18 acts as a reciprocal lever arm, forcing the inside edge 106 of ski 16 down. As the inside edge 106 of ski 16 is forced down, ski 16 behaves as ski 14, and rolls about its edge 106, thus, elevationally raising outside edge 108. The linkage system of the present invention preferably ensures that the movements of skis 14 and 16 are substantially uniform and coordinated.

As perpendicular axis 516 of the main assembly 30 moves inline with the true force vector 505 applied by the rider (see FIG. 12 and FIG. 1), the distribution of weight/force, as between skis 14 and 16, returns to a substantially equal state, with weight/force being born primarily by edges 100 and 106 of skis 14 and 16, respectively. Simplistically, edges 100 and 106 are again bearing a substantially equal load (of the skier's overall weight force) 502, and the applied force 505 is substantially equally distributed as force 518. As shown, force 518 is substantially perpendicular to the bottom of skis 14 and 16, and directly in line with applied force 505. [If this preferred condition of alignment is not achieved, the skier will slide, and the turn will fail.]

With reference to FIGS. 1, 11, 12 and 13, the ability of applicant's preferred embodiments of the present invention to maintain a substantially uniform horizontal separation between skis 14 and 16 can be understood and appreciated. Throughout the entire process of rotating an edge, the relative distance between the points of contact with the snow 104 for ski 14 remains constant from respective points of contact with the snow 104 for ski 16. This is preferred, for it does not impose counter-productive forces upon the forward motion of the skis. More specifically, the relative motion of the skis, as desired by the skier, is along the longitudinal axes of the skis. It is undesirable, in the process of rolling an edge, to actively draw one ski toward another, for such forced motion is perpendicular to the desired direction of travel, and at the very least, increases drag and friction. Thus, the embodiments of the present invention enable a preferred smooth and uniform sensation in turning for the skier, without imposing additional balance issues and drag forces contrary to the direction of travel.

It is to be understood that the depictions provided in FIGS. 11, 12 and 13 are "normalized" cross-sections only. In practice, and as described above, the change of weight and loading force causes skis 14 and 16 to deform, shortening the radius of curvature along the edges 100 and 106, or 102 and 104 respectively. This desired behavior is preferably achieved by the linkage system 12 or 12'.

Applicant's use of a linkage system to permit the stance desired by a snow boarder (see FIG. 2) while applying the force to the skis in the area designated by the ski manufacturer, is truly preferred for radius of curvature. More specifically, the conical section imparted to the ski in the process of turning is a fundamental design characteristic. If the weight of the rider is applied fore and aft of the ski manufacturer's intended spot of binding attachment, a radius of curvature, though still affected, will not be the preferred curvature intended by the ski manufacturer.

With respect to FIG. 12, it should be noted that the relationship of the skis depicted for the description of effectuating a turn is the same as the relationship of the skis, should the skier be traversing the slope. By necessity, for the skier's weight to be equally distributed between the skis, one ski must be elevationally above the other so that both may be in contact with the snow. It is also understood and appreciated that the forces giving rise to a turn are quite numerous, including gravity, centrifugal force, and even the articulation of the skier's ankles. However, and by whatever means, a rotational force is applied to either the main assembly 30 or the main geared assembly 56, or an elevational change occurs with respect to one ski, the linkage system 12 or 12' under the present invention will ensure that motion and alignment of skis 14 and 16 is substantially maintained.

Figure 14:
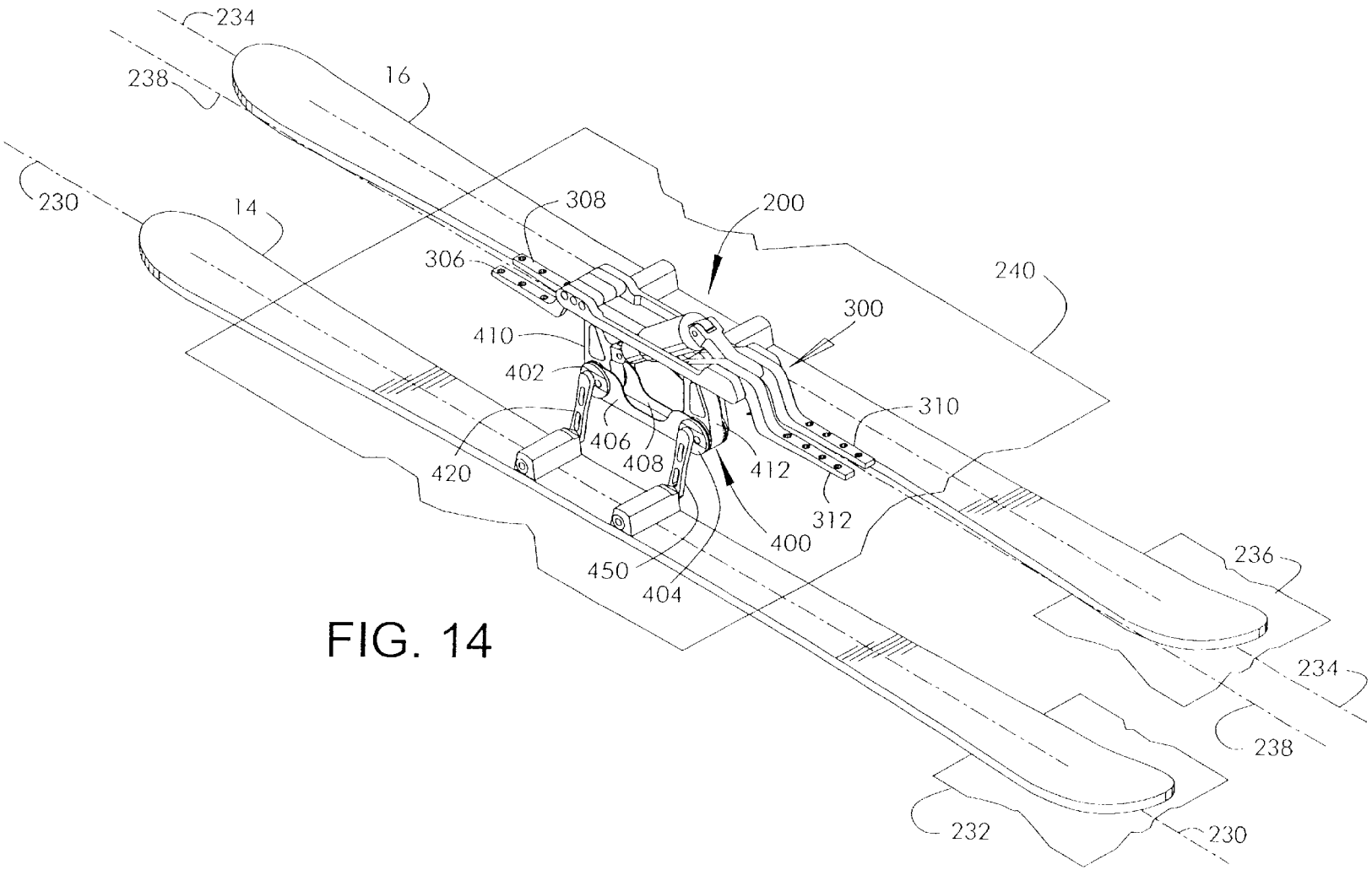
FIG. 14 is a detailed perspective view of the preferred embodiment shown in FIG. 2.

FIG. 14 illustrates a geared linkage assembly 200, according to an alternative embodiment of the present invention, incorporating the ability to dampen shock, store potential energy, and provide the skier with the ability to remain at substantially the same elevation as the uppermost ski. This alternative geared linkage assembly 200 is comprised of a rider assembly 300 and a sub-assembly 400. The operation of the sub-assembly is substantially the same as that described above with regard to the geared crank linkage assembly shown in FIGS. 7, 8 and 9. Under appropriate circumstances, the double throw crank assembly utilizing double throw cranks 18 and 20, as described above, may also be used in place of geared cranks.

Figure 15:
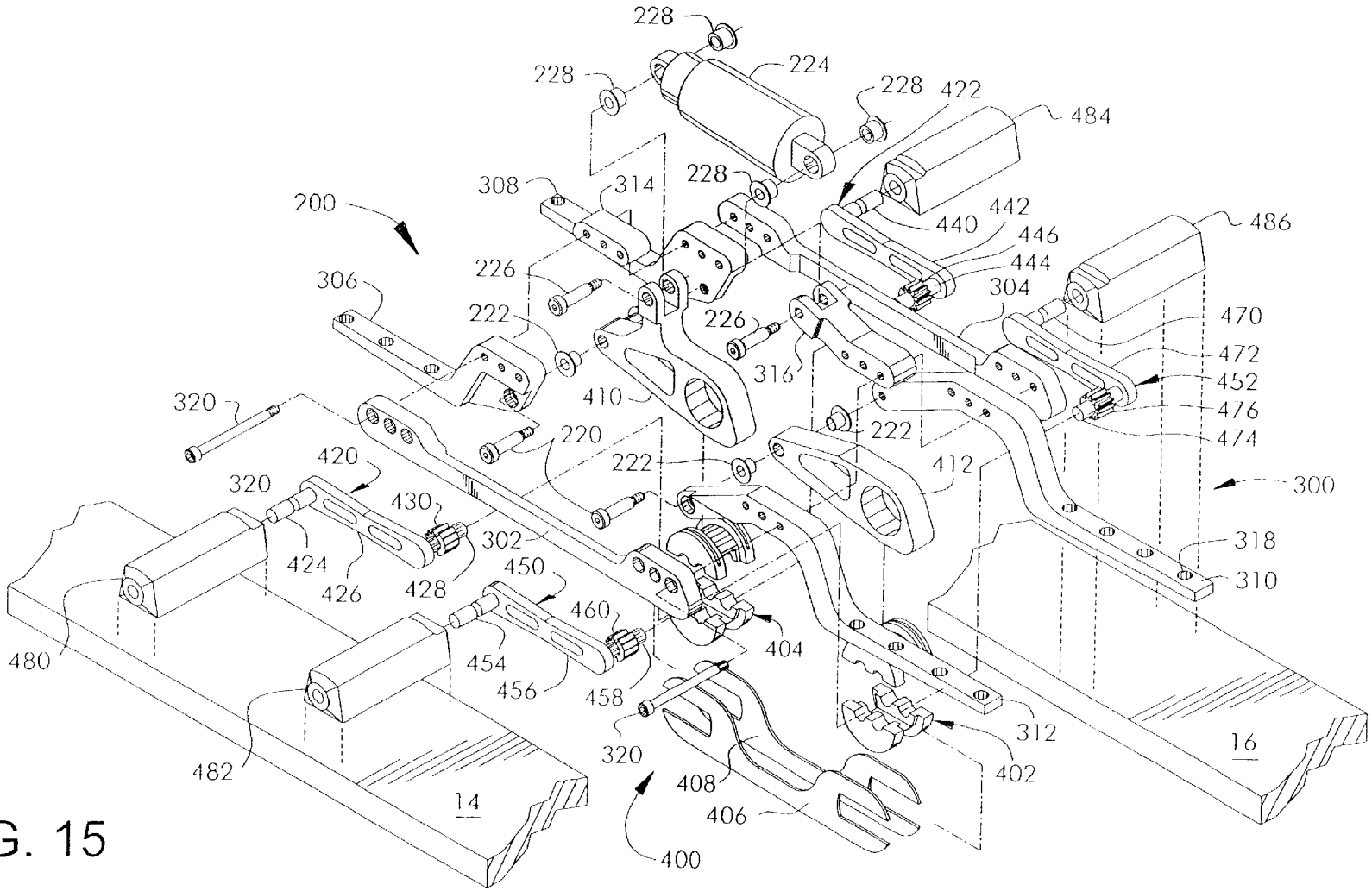
FIG. 15 is an exploded perspective view of a preferred embodiment of the present invention shown in FIG. 14.

FIG. 15 is an exploded view of geared linkage assembly 200, permitting an overview of construction. The rider assembly 300 is substantially comprised of two side rails 302 and 304, a rearward binding attachment structure comprised of struts 306 and 308, a forward binding attachment structure comprised of struts 310 and 312, spacer 314, and actuator mount 316. Struts 306, 308, 310 and 312 provide binding screw holes 318, as are commonly expected in the industry, for securing boot bindings (embodying herein at least one rider assembly structured and arranged to provide at least one mounting for at least one boot binding). Preferably, bolts 320 are used to rigidly bind the rails, struts, spacer and actuator mount together, as shown and discussed. As shown, there are three bolts 320, intended for securing the forward section of the rider assembly 300, and three bolts 320 intended for securing the aft section of the rider assembly 300. Preferably, bolts 320 are set into threaded holes appropriately located in rail 304. Under appropriate circumstances, other binding means, such as bolts with nuts, screws, rivets, welds and glue may be used to effectuate a unified rider assembly. Milling and/or casting of a solid rider assembly may be employed, as well; however, the assemblage from parts is preferred on the basis of cost.

In the preferred embodiment, the fore and aft mounting elements comprised of struts 310, 312 and 306, 308 are constructed such that gear housings 402 and 404 are between the mounting elements set to receive the boot bindings (embodying herein at least one bearing box structured and arranged to attach to the at least one mounting assembly between locations for the two boot bindings). When the rider assembly 300 and sub-assembly 400 are at the maximum point of elevation above the skis 14 and 16, preferably, the geared cranks will be perpendicular in orientation relative to both skis. In such configuration, it can be most easily appreciated that journal boxes 22, 24, 26 and 28 apply the skier's weight to the skis at a point between the skier's boots, as attached by bindings, to struts 310, 312 and 306, 308. More specifically, as discussed, the skier's weight is applied to the skis substantially proximate to the binding attachment points intended by the ski manufacturer. Conventionally, when snowboarding, the stance of the skier is such that his or her weight is applied to the fore and aft section of the board, and not to the middle. Should this stance be applied directly to a ski, the application of weight is not proximate to the binding attachment points intended by the ski manufacturer 110.

The sub-assembly 400, as shown in FIG. 14, is comprised of two substantially identical gear housings 402 and 404, guide rails 406 and 408, aft push arm 410, and forward push arm 412. Two skis 14 and 16 are interconnected by sub-assembly 400, further comprising a fore and aft geared crank (embodying herein at least one sub-assembly structured and arranged to attach to the at least one linkage).

The aft geared crank is preferably comprised of two throw arms 420 and 422. Respectively, throw arm 420 has a free end 424 perpendicularly connected to offset 426. Offset 426 is, in turn, perpendicularly connected to shaft 428. Gear 430 is attached to shaft 438. Throw arm 422 has free end 440 perpendicularly connected to offset 442. Offset 442 is, in turn, perpendicularly connected to shaft 444. Gear 446 is attached to shaft 444. Gear 446 meshes with gear 430, both of which are contained in a gear housing 404.

The forward geared crank is preferably comprised of two throw arms 450 and 452. Respectively, throw arm 450 has a free end 454 perpendicularly connected to offset 456. Offset 456 is, in turn, perpendicularly connected to shaft 458. Gear 460 is attached to shaft 458. Throw arm 452 has free end 470 perpendicularly connected to offset 472. Offset 472 is, in turn, perpendicularly connected to shaft 474. Gear 476 is attached to shaft 474. Gear 476 meshes with gear 460, both of which are contained in a gear housing 402. Preferably, gears 430, 446, 472 and 476 incorporate stops to prevent rotation beyond 90 degrees.

The components comprising throw arms 420, 422, 450 and 452 are preferably rigidly affixed, one to another, and are co-planar. The assemblage and properties of the throw arms discussed above with respect to FIG. 7 are substantially the same as the throw arms shown here. As discussed above, if angles other than right angles are used, the skis may become splayed or stemmed as they move vertically, one to another. Free ends 424 and 454 are received by guide journal boxes 480 and 482, respectively attached to ski 14. Free ends 440 and 470 are received by guide journal boxes 484 and 486, respectively attached to ski 16.

Figure 17:
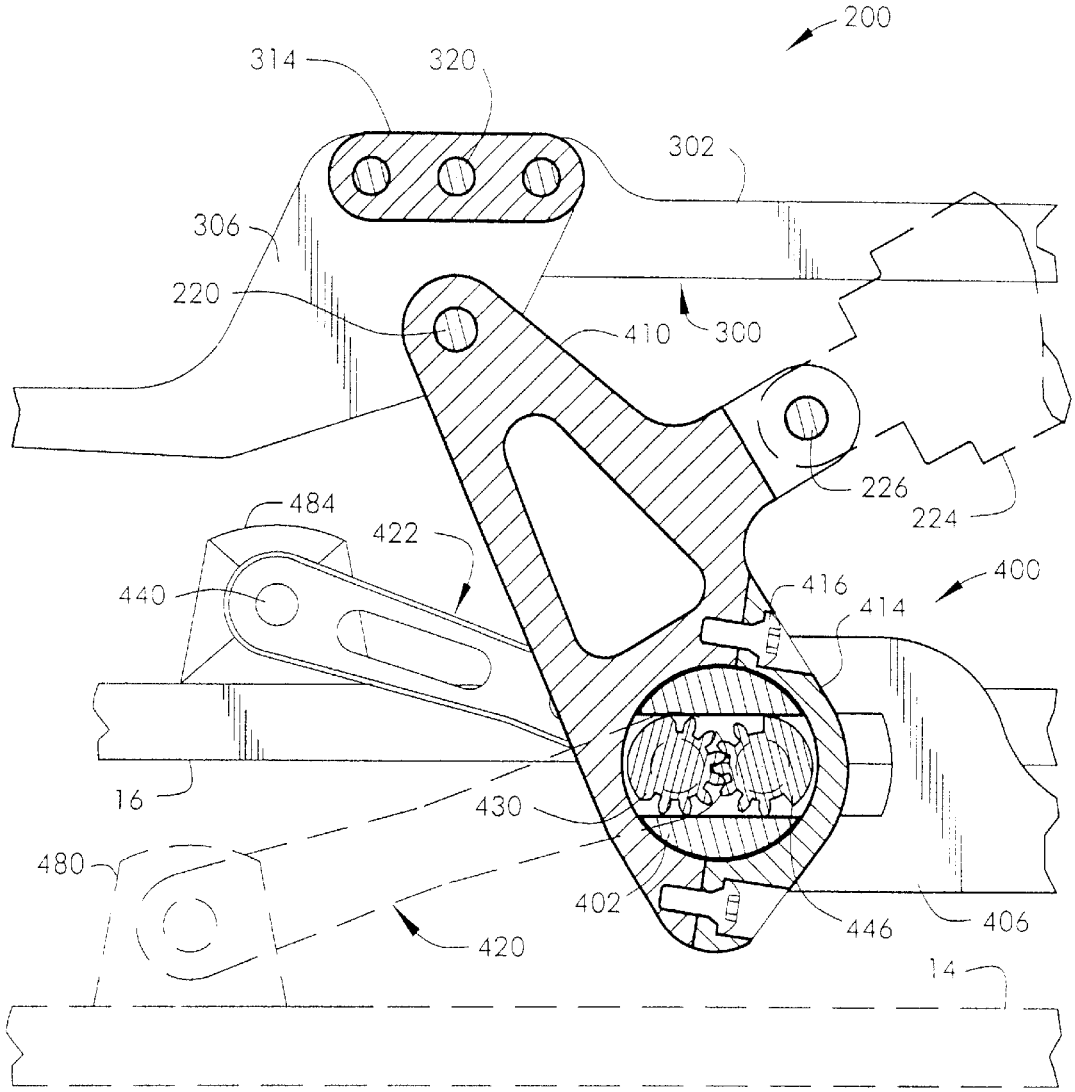
FIG. 17 is a detailed partial aft sectional view further illustrating the preferred embodiment as shown in FIG. 2.
Figure 18:
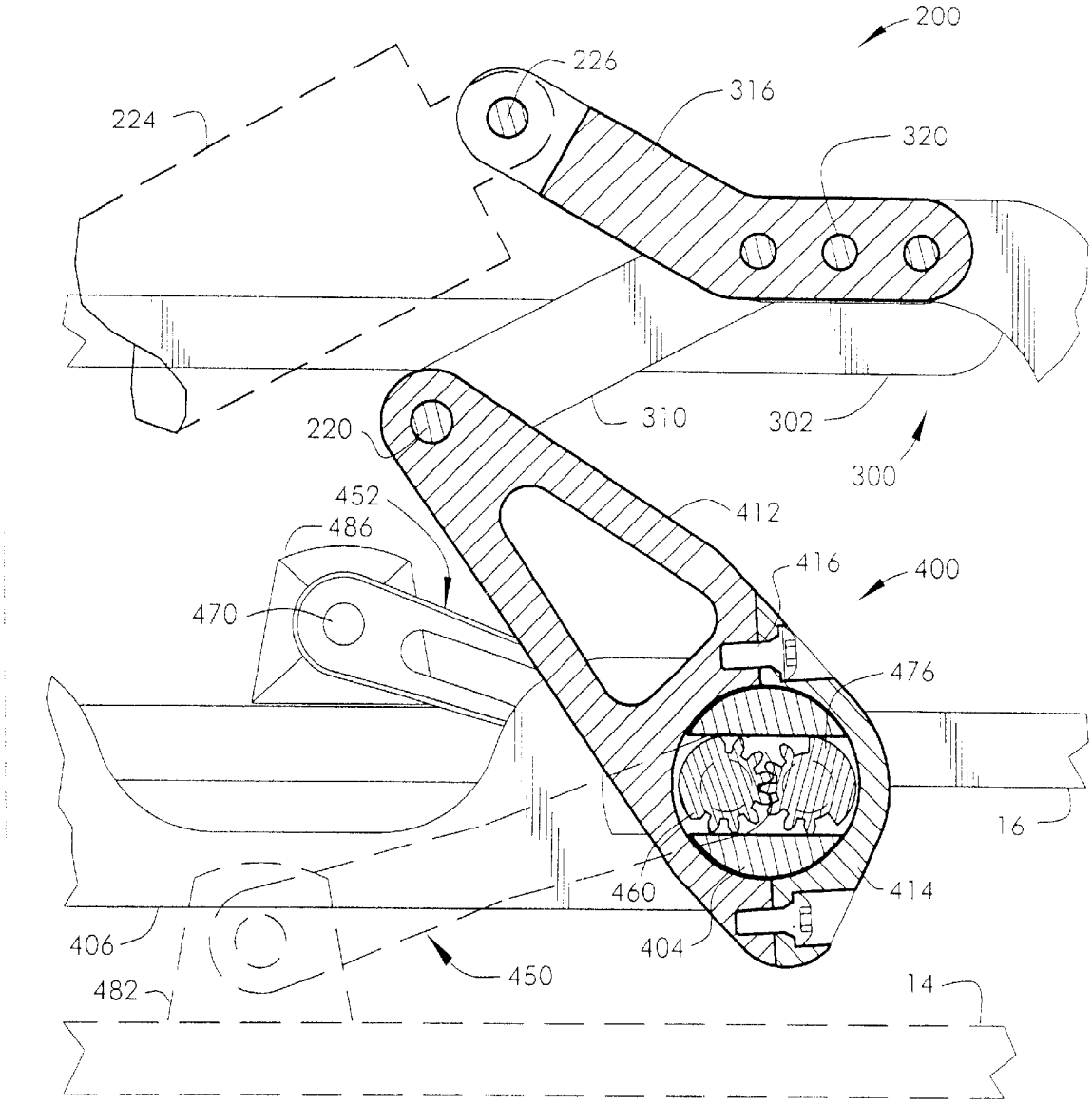
FIG. 18 is a detailed partial forward sectional view illustrating the preferred embodiment as shown in FIG. 2.

Referring now to FIGS. 17 and 18, they provide partial sectional views of the fore (FIG. 18) and aft (FIG. 17) sections of the geared linkage assembly 200, as preferably comprised of the interconnected rider assembly 300 and sub-assembly 400. With respect to FIGS. 17 and 18, gear housing 402 is encircled by aft push arm 410 such that gear housing 402 serves as an axis of rotation for aft push arm 410. Likewise, gear housing 404 is encircled by forward push arm 412 such that gear housing 404 serves as an axis of rotation for forward push arm 412. To facilitate mounting of the push arms about the gearboxes, preferably half of the portion of the push arm encircling the gearbox is made removable, i.e., a removable bearing cap 414. Screws 416 bind the bearing cap 414 firmly to the push arm assembly. Preferably, the remaining end of the aft push arm 410 serves to attach the sub-assembly 400 to the rider assembly 300

(embodying herein that attached to the sub-assembly, at least one rider assembly). This connection is accomplished by placing the end of the aft push arm 410 between struts 306 and 308, preferably held appropriately apart by spacer 314. A bolt 220 is preferably used to secure aft push arm 410, and bushings 222 preferably ensure free rotation about bolt 220. The remaining end of the forward push arm 412 also preferably serves to attach the sub-assembly 400 to the rider assembly 300 (at least one connection bar structured and arranged to rotatably attach between the at least one rider assembly and the at least one sub-assembly). This connection is accomplished by placing the end of the forward push arm 412 between struts 310 and 312, preferably held apart by an actuator mount 316. A bolt 220 is preferably used to secure forward push arm 412, and bushings 222 preferably ensure free rotation about bolt 220 (embodying herein wherein the at least one rider assembly is permitted to rotate about an axis of rotation transverse to the third longitudinal axis). As bolts 220 are transverse to axis 238, the rider assembly 300 is permitted to rotate about an axis of rotation transverse to axis 238 (embodying herein the at least one rider assembly permitted to rotate about an axis of rotation transverse to the third longitudinal axis).

An expansion system is, in turn, preferably attached between aft push arm 410 and actuator mount 316. Preferably, the expansion system is comprised of an expansion actuator 224. Preferably, bolts 226 secure the actuator 224, and bushings 228 preferably ensure free rotation of the actuator about each bolt. Preferably, actuator 224 is of either a pneumatic or hydraulic style commonly used with mountain bikes and/or handicapped sit skis. Actuator 224 when at rest, is fully extended, thus causing the geared linkage assembly to fully expand such that rider assembly 300 and sub-assembly 400 are forced apart, as depicted in FIG. 14. Preferably, actuator 224 is adjustable so that the rider may adjust the relative level of compression such that his or her weight is sufficient to compress the actuator 224 so that side rails 302 and 304 of rider assembly 300 preferably contact the tops of guide journal boxes 482, 484, 486 and 488 (embodying herein wherein the at least one expansion system structured and arranged to apply separation force between the at least one rider assembly and the at least one sub-assembly). [See also FIGS. 16 and 20.]

Figure 19:
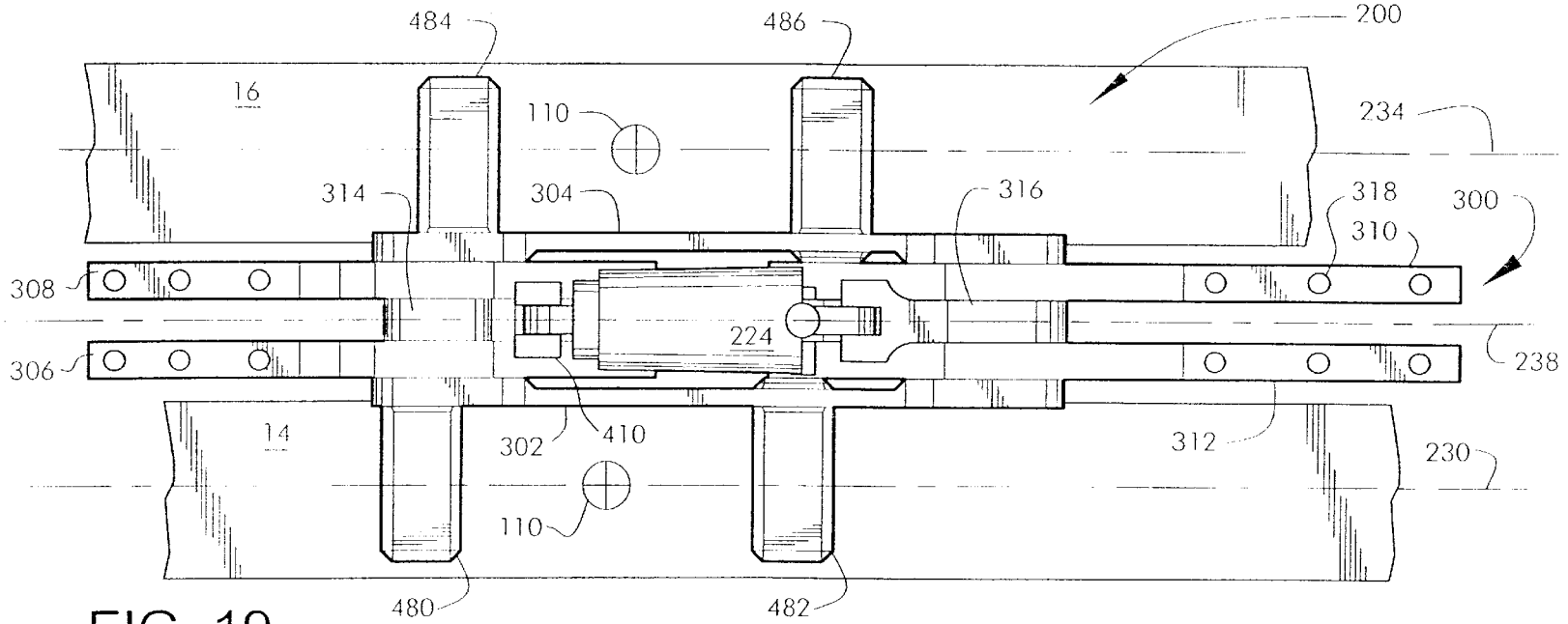
FIG. 19 is a detailed top elevational view further illustrating the preferred embodiment as shown in FIG. 2.
Figure 20:
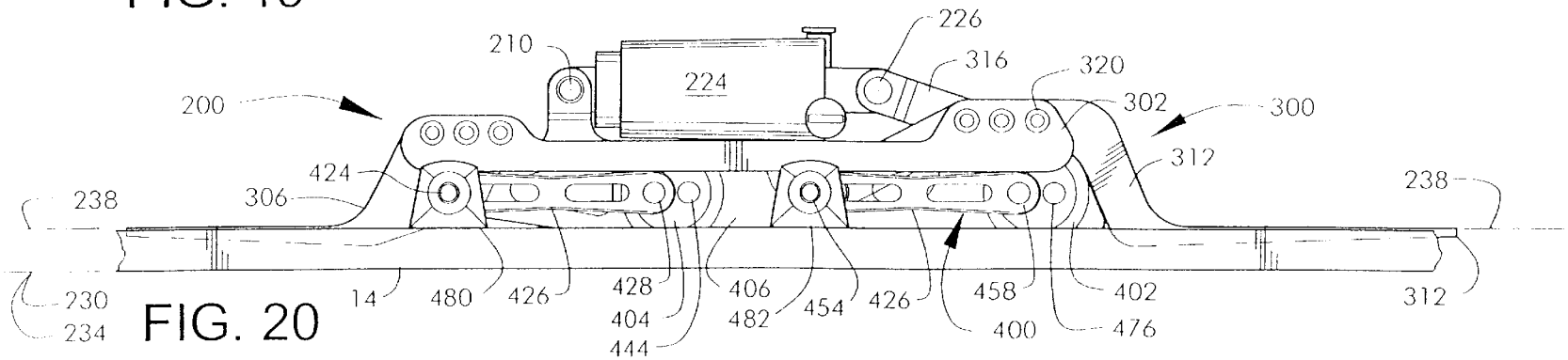
FIG. 20 is a detailed side elevational view further illustrating the preferred embodiment as shown in FIG. 2.

FIG. 19 and FIG. 20 provide a top and side elevational view, respectively, of the geared linkage assembly 200 comprising the rider assembly 300 and sub-assembly 400 in relation to skis 14 and 16 when the geared linkage assembly is under load. With respect to FIG. 20, struts 306 and 312, which serve to provide fore and aft mounting points for binding attachment, are slightly above the top surface of skis 14 and 16. The preferred contact of guide rail 320 with journal boxes 480 and 482 is depicted, as well. Preferably, the sub-assembly 400 and rider assembly 300 are designed so as to form a compact structure when compressed, as shown. As shown, the attachment points of geared linkage assembly 200 by means of journal boxes 480, 482, 484 and 486 is between the preferred mounting means set to receive the bindings of the skier.

Figure 16:
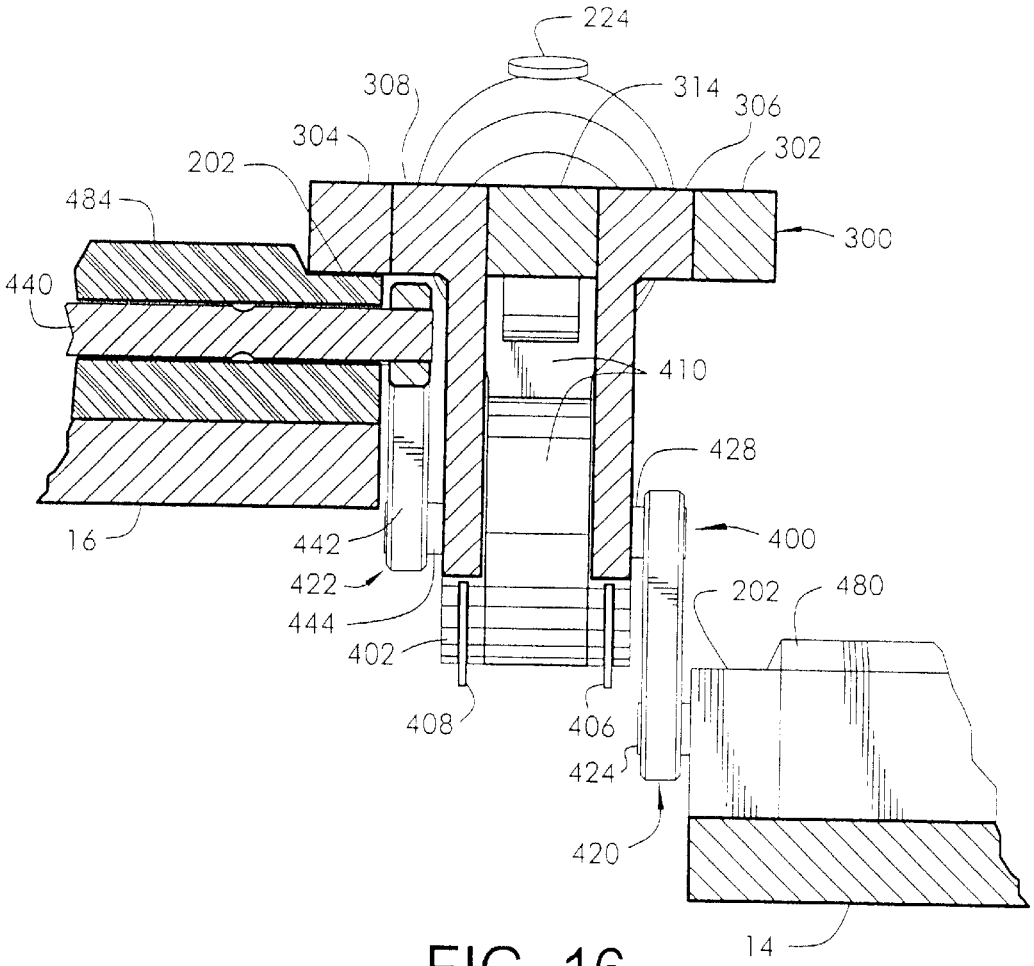
FIG. 16 is a detailed partial sectional view illustrating the preferred embodiment shown in FIG. 1.

FIG. 16 is a cross-sectional view of the present invention applying the geared linkage assembly 200 and demonstrating the arrangement of components when ski 14 is elevationally below ski 16. As shown, side rail 304 is seated against guide journal box 484 such that the rider assembly 300 remains elevationally above the top most ski, as shown, this is ski 16. Preferably, guide journal boxes 484 and 486 have a notch 202 to receive side rail 304. As discussed above, with respect to FIGS. 8 and 9, the rotation of throw arm 422 is coordinated with the rotation of throw arm 420 by the meshed gears held in gear housing 402.

When traversing a hill such that the point of contact with the snow is elevationally different for each ski, or when rolling an edge to effectuate a turn (both discussed above with respect to FIGS. 1, 11, 12 and 13), the downhill ski or ski on the outside of the turn is forced elevationally away from the rider assembly 300 by actuator 224 expanding against the aft push arm 410. Aft push arm 410, in turn, acts as a lever driving horizontal motion of the sub-assembly 400. Forward push arm 412 rotates in a motion substantially symmetrical to the rotation of aft push arm 410, thus maintaining a parallel orientation between the sub-assembly 400 and the rider assembly 300. Horizontal movement of the sub-assembly 400 imparts a direct cause of rotation to the nested gears between the forward throw arms 422 and 424, and the rearward throw arms 450 and 452, which in turn, synchronize the motion and alignment of skis 14 and 16.

The principle of turning, as described with reference to FIGS. 1, 11, 12 and 13 applies to the geared linkage assembly 200, as well. When employing linkage 200, the application of force substantially perpendicular to the direction of travel initiates a transfer of applied force from the outside ski to the inside ski. The result of the motion of aft push arm 410 and forward push arm 412 and the stability provided by the guide journal boxes 484 and 486 in connection with the side rail 304, provides the skier with a preferred natural sensation of weight transfer between the skis and their corresponding rotation. From the skier's point of view, his or her placement over the skis and relative to the skis does not change. He or she remains preferably above, and preferably in contact with the upper most ski. Thus, the present invention enables a smooth and uniform sensation in turning for the skier, without imposing additional balance issues and drag forces contrary to the direction of travel.

Having thus described the invention, it is noted that all or some advantages of the present invention in improving performance, control and maneuverability through a lightweight simple linkage system maintaining substantial symmetry between two skis through a central point of contact may be applied, under appropriate circumstances, to many other applications, as well, e.g., snowmobiles, sled runners, etc., and those skilled in the art, from this description, will be enabled to determine which elements to modify to pursue such applications.

Preferably, the gearboxes and journal boxes are made from a thermoplastic material, preferably thermoplastic, such as polycarbonate. Preferably, the cranks are manufactured from metal, preferably steel bar, preferably stainless steel bar, suitably splined or flattened to engage the gears. Preferably, the gears are metal, preferably hardened metal; however, under appropriate circumstances, they may be plastic, brass or formed resin, depending upon the width of the gear and the intended size and forces applied by the skier. Under appropriate circumstance, for example, using a plastic gear with a width of an inch or so, the strain on the teeth of the gear is not excessive. Although gears are disclosed as the preferred method of coordinating the rotary crank movement, under appropriate circumstances, other means of producing the coordinated movement, such as frictional engagement, chains or other such coupling means, are considered within the scope of the invention. Paralleling the assembly of the geared crank assembly discussed above with respect to FIG. 7, such coordinated crank movement would employ a substantially co-linear shaft in place of the shaft and gear combination discussed above (embodying herein at least one substantially co-linear shaft).

Preferably, the mounting elements and struts for receiving the boot bindings are manufactured from durable materials, such as aircraft-grade aluminum, steel and/or titanium. However, it is understood that the choice of materials for these and all linkage components is to be a matter of design for those of skill in the manufacturing of ski equipment. Preferably, bearings, seals, lubricants and other construction details are also a matter of design. As noted above, this snowboard system can incorporate a wide variety of skis. Preferably, in any given configuration of the present invention, skis of substantially the same size and width are used. Under appropriate circumstances, such as "freestyle" skiing, it may be desirable to practice the invention with skis of different lengths and/or widths. Use of skis of different lengths and/or widths will affect the geometries involved in turning, as well as traveling straight. Preloading of one ski and/or additional riser spacers beneath one set of journal boxes may be desired to improve ride characteristics in such circumstances. Preferably, the offsets of the rear cranks are the same size as the offsets of the front cranks; however, under appropriate circumstances, a skier may desire rear cranks with a longer offset. While the overall length of the offsets depends upon skill and terrain, a length equal to the width of a ski is a good starting point.

Although applicant has described applicant's preferred embodiments of this invention, it will be understood that the broadest scope of this invention includes such modifications as diverse shapes and sizes and materials. Such scope is limited only by the below claims as read in connection with the above specification. Further, many other advantages of applicant's invention will be apparent from the above descriptions and the below claims.

What is claimed is:

1. A snowboard system, comprising, in combination:

a) at least one first ski lying substantially in a first plane and having a first longitudinal axis;

b) at least one second ski lying substantially in a second plane and having a second longitudinal axis;

c) at least one mounting assembly structured and arranged to mount at least one boot binding; and d) at least one linkage structured and arranged to link said at least one mounting assembly to and between said at least one first ski and said at least one second ski;

e) said at least one mounting assembly lying normally in a substantially horizontal third plane above the first and second planes and having a third longitudinal axis;

f) wherein said at least one linkage is structured and arranged to i) maintain the first and second planes normally substantially parallel to the third plane, ii) maintain the first, second and third planes to be never simultaneously collectively co-planar, iii) maintain substantially parallel alignment among the first longitudinal axis, second longitudinal axis and third longitudinal axis;

iv) control vertical motion among the first longitudinal axis, second longitudinal axis and third longitudinal axis;

v) maintain substantially fixed horizontal separation among the first longitudinal axis, second longitudinal axis and third longitudinal axis;

vi) permit rotation of said at least one first ski and said at least one second ski about an axis of rotation transverse to the third longitudinal axis; and vii) permit cant between said at least one first ski relative to said at least one second ski.

2. The snowboard system according to claim 1 wherein said at least one linkage is structured and arranged to control vertical motion among the first longitudinal axis, second longitudinal axis and third longitudinal axis so that vertical motion of the first longitudinal axis is approximately equal and opposite to vertical motion of the second longitudinal axis relative to the third longitudinal axis.

3. The snowboard system according to claim 1 wherein said at least one linkage is structured and arranged to impart motion to said at least one mounting assembly along the third longitudinal axis in response to vertical motion among the first longitudinal axis, second longitudinal axis and third longitudinal axis.

4. The snowboard system according to claim 1 wherein said at least one linkage comprises:

a) at least one double throw crank, each said at least one double throw crank having i) at least one substantially co-linear shaft, ii) a first free end parallel with said at least one substantially co-linear shaft and having a first offset from said at least one substantially co-linear shaft, and iii) a second free end parallel with said at least one substantially co-linear shaft and having a second offset from said at least one substantially co-linear shaft;

b) at least one first journal box structured and arranged to attach to said at least one first ski, said at least one first journal box being structured and arranged to receive said first free end of said at least one double throw crank;

c) at least one second journal box structured and arranged to attach to said at least one second ski, said at least one second journal box being structured and arranged to receive said second free end of said at least one double throw crank; and d) at least one crank support box structured and arranged to attach to said at least one mounting assembly, said at least one crank support box being structured and arranged to receive said at least one substantially co-linear shaft in a position substantially transverse to the third longitudinal axis.

5. The snowboard system according to claim 1 wherein each said at least one linkage comprises:

a) a solid double throw crank, said solid double throw crank having i) a shaft, ii) a first free end parallel with said shaft and having a first offset from said shaft, and iii) a second free end parallel with said shaft and having a second offset from said shaft;

b) at least one first journal box structured and arranged to attach to said at least one first ski, said at least one first journal box being structured and arranged to receive said first free end of said solid double throw crank;

c) at least one second journal box structured and arranged to attach to said at least one second ski, said second journal box being structured and arranged to receive said second free end of said solid double throw crank; and d) at least one bearing box structured and arranged to attach to said at least one mounting assembly, said at least one bearing box being structured and arranged to receive said shaft in a position substantially transverse to the third longitudinal axis.

6. The snowboard system according to claim 5 wherein said at least one linkage comprises at least two said linkages.

7. The snowboard system according to claim 5 wherein said at least one linkage is structured and arranged to impart motion to said at least one mounting assembly along the third longitudinal axis in response to vertical motion among the first longitudinal axis, second longitudinal axis and third longitudinal axis.

8. The snowboard system according to claim 5 wherein said at least one mounting assembly is structured and arranged to mount two boot bindings.

9. The snowboard system according to claim 8 wherein said at least one bearing box is structured and arranged to attach to said at least one mounting assembly between locations for the two boot bindings.

10. The snowboard system according to claim 1 wherein each said at least one linkage comprises:

a) an articulated double throw crank, said articulated double throw crank having
   i) a first shaft comprising a first gear,
   ii) a first free end parallel with said first shaft and having a first offset from said first shaft,
   iii) a second shaft comprising a second gear,
   iv) a second free end parallel with said second shaft and having a second offset from said second shaft;

b) at least one first journal box structured and arranged to attach to said at least one first ski, said at least one first journal box being structured and arranged to receive said first free end of said articulated double throw crank;

c) at least one second journal box structured and arranged to attach to said at least one second ski, said second journal box being structured and arranged to receive said second free end of said articulated double throw crank; and d) at least one gearbox structured and arranged to attach to said at least one mounting assembly, said at least one gearbox being further structured and arranged to receive and house said first gear and said second gear in meshing relationship, with said first and second shafts in positions substantially transverse to the third longitudinal axis, so that said first free end and said second free end rotate about said gearbox in opposite directions.

11. The snowboard system according to claim 10 wherein said at least one linkage comprises two said linkages.

12. The snowboard system according to claim 10 wherein said at least one linkage is structured and arranged to impart motion to said at least one mounting assembly along the third longitudinal axis in response to vertical motion among the first longitudinal axis, second longitudinal axis and third longitudinal axis.

13. The snowboard system according to claim 10 wherein said at least one mounting assembly is structured and arranged to mount two boot bindings.

14. The snowboard system according to claim 13 wherein said at least one gearbox is structured and arranged to attach to said at least one mounting assembly between locations for the two boot bindings.

15. The snowboard system according to claim 1 wherein said at least one mounting assembly comprises, in combination:

a) at least one sub-assembly structured and arranged to attach to said at least one linkage;

b) attached to said sub-assembly, at least one rider assembly structured and arranged to provide at least one mounting for at least one boot binding;

c) at least one connection bar structured and arranged to rotatably attach between said at least one rider assembly and said at least one sub-assembly, wherein said at least one rider assembly is permitted to rotate about an axis of rotation transverse to the third longitudinal axis; and d) at least one expansion system structured and arranged to apply separation force between said at least one rider assembly and said at least one sub-assembly.

16. The snowboard system according to claim 15, wherein said at least one expansion system is structured and arranged to be adjustable.

17. The snowboard system according to claim 4 wherein said at least one mounting assembly comprises, in combination:

a) at least one sub-assembly structured and arranged to attach to said at least one linkage;

b) attached to said sub-assembly, at least one rider assembly structured and arranged to provide at least one mounting for at least one boot binding;

c) at least one connection bar structured and arranged to rotatably attach between said at least one rider assembly and said at least one sub-assembly, wherein said at least one rider assembly is permitted to rotate about an axis of rotation transverse to the third longitudinal axis; and d) at least one expansion system structured and arranged to apply separation force between said at least one rider assembly and said at least one sub-assembly.

18. An apparatus, for linking at least one first ski lying substantially in a first plane and having a first longitudinal axis to at least one second ski lying substantially in a second plane and having a second longitudinal axis, comprising, in combination:

a) at least one mounting assembly structured and arranged to mount at least one boot binding; and b) at least one linkage structured and arranged to link said at least one mounting assembly to and between said at least one first ski and said at least one second ski;

c) said at least one mounting assembly lying normally in a substantially horizontal third plane above the first and second planes and having a third longitudinal axis;

d) wherein said at least one linkage is structured and arranged to
   i) maintain the first and second planes normally substantially parallel to the third plane,
   ii) maintain the first, second and third planes to be never simultaneously collectively co-planar,
   iii) maintain substantially parallel alignment among the first longitudinal axis, second longitudinal axis and third longitudinal axis;
   iv) control vertical motion among the first longitudinal axis, second longitudinal axis and third longitudinal axis;
   v) maintain substantially fixed horizontal separation among the first longitudinal axis, second longitudinal axis and third longitudinal axis;
   vi) permit rotation of said at least one first ski and said at least one second ski about an axis of rotation transverse to the third longitudinal axis;
   vii) permit cant between said at least one first ski relative to said at least one second ski.

19. The apparatus according to claim 18 wherein said at least one linkage is structured and arranged to control vertical motion among the first longitudinal axis, second longitudinal axis and third longitudinal axis so that vertical motion of the first longitudinal axis is approximately equal and opposite to vertical motion of the second longitudinal axis relative to the third longitudinal axis.

20. The apparatus according to claim 18 wherein said at least one linkage is structured and arranged to impart motion to said at least one mounting assembly along the third longitudinal axis in response to vertical motion among the first longitudinal axis, second longitudinal axis and third longitudinal axis.

21. The apparatus according to claim 18 wherein said at least one linkage comprises:

a) at least one double throw crank, each said at least one double throw crank having
   i) at least one substantially co-linear shaft,
   ii) a first free end parallel with said at least one substantially co-linear shaft and having a first offset from said at least one substantially co-linear shaft, and
   iii) a second free end parallel with said at least one substantially co-linear shaft and having a second offset from said at least one substantially co-linear shaft;

b) at least one first journal box structured and arranged to attach to the at least one first ski, said at least one first journal box being structured and arranged to receive said first free end of said at least one double throw crank;

c) at least one second journal box structured and arranged to attach to the at least one second ski, said at least one second journal box being structured and arranged to receive said second free end of said at least one double throw crank; and d) at least one crank support box structured and arranged to attach to said at least one mounting assembly, said at least one crank support box being structured and arranged to receive said at least one substantially co-linear shaft in a position substantially transverse to the third longitudinal axis.

22. The apparatus according to claim 18 wherein each said at least one linkage comprises:

a) a solid double throw crank, said solid double throw crank having
   i) a shaft,
   ii) a first free end parallel with said shaft and having a first offset from said shaft, and
   iii) a second free end parallel with said shaft and having a second offset from said shaft;

b) at least one first journal box structured and arranged to attach to the at least one first ski, said at least one first journal box being structured and arranged to receive said first free end of said solid double throw crank;

c) at least one second journal box structured and arranged to attach to the at least one second ski, said second journal box being structured and arranged to receive said second free end of said solid double throw crank; and d) at least one bearing box structured and arranged to attach to said at least one mounting assembly, said at least one bearing box being structured and arranged to receive said shaft in a position substantially transverse to the third longitudinal axis.

23. The apparatus according to claim 22 wherein said at least one linkage comprises at least two said linkages.

24. The apparatus according to claim 22 wherein said at least one linkage is structured and arranged to impart motion to said at least one mounting assembly along the third longitudinal axis in response to vertical motion among the first longitudinal axis, second longitudinal axis and third longitudinal axis.

25. The apparatus according to claim 22 wherein said at least one mounting assembly is structured and arranged to mount two boot bindings.

26. The apparatus according to claim 25 wherein said at least one bearing box is structured and arranged to attach to said at least one mounting assembly between locations for the two boot bindings.

27. The apparatus according to claim 18 wherein each said at least one linkage comprises:

a) an articulated double throw crank, said articulated double throw crank having
   i) a first shaft comprising a first gear,
   ii) a first free end parallel with said first shaft and having a first offset from said first shaft,
   iii) a second shaft comprising a second gear,
   iv) a second free end parallel with said second shaft and having a second offset from said second shaft;

b) at least one first journal box structured and arranged to attach to the at least one first ski, said at least one first journal box being structured and arranged to receive said first free end of said articulated double throw crank;

c) at least one second journal box structured and arranged to attach to the at least one second ski, said second journal box being structured and arranged to receive said second free end of said articulated double throw crank; and d) at least one gearbox structured and arranged to attach to said at least one mounting assembly, said at least one gearbox being further structured and arranged to receive and house said first gear and said second gear in meshing relationship, with said first and second shafts in positions substantially transverse to the third longitudinal axis, so that said first free end and said second free end rotate about said gearbox in opposite directions.

28. The apparatus according to claim 27 wherein said at least one linkage comprises two said linkages.

29. The apparatus according to claim 27 wherein said at least one linkage is structured and arranged to impart motion to said at least one mounting assembly along the third longitudinal axis in response to vertical motion among the first longitudinal axis, second longitudinal axis and third longitudinal axis.

30. The apparatus according to claim 27 wherein said at least one mounting assembly is structured and arranged to mount two boot bindings.

31. The apparatus according to claim 30 wherein said at least one gearbox is structured and arranged to attach to said at least one mounting assembly between locations for the two boot bindings.

32. The apparatus according to claim 18 wherein said at least one mounting assembly comprises, in combination:

a) at least one sub-assembly structured and arranged to attach to said at least one linkage;

b) attached to said sub-assembly, at least one rider assembly structured and arranged to provide at least one mounting for at least one boot binding;

c) at least one connection bar structured and arranged to rotatably attach between said at least one rider assembly and said at least one sub-assembly, wherein said at least one rider assembly is permitted to rotate about an axis of rotation transverse to the third longitudinal axis; and d) at least one expansion system structured and arranged to apply separation force between said at least one rider assembly and said at least one sub-assembly.

33. The apparatus according to claim 32, wherein said at least one expansion system is structured and arranged to be adjustable.

34. The apparatus according to claim 21 wherein said at least one mounting assembly comprises, in combination:

a) at least one sub-assembly structured and arranged to attach to said at least one linkage;

b) attached to said sub-assembly, at least one rider assembly structured and arranged to provide at least one mounting for at least one boot binding;

c) at least one connection bar structured and arranged to rotatably attach between said at least one rider assembly and said at least one sub-assembly, wherein said at least one rider assembly is permitted to rotate about an axis of rotation transverse to the third longitudinal axis; and d) at least one expansion system structured and arranged to apply separation force between said at least one rider assembly and said at least one sub-assembly.

* * * * *